US011193190B2

(12) United States Patent
Maziasz et al.

(10) Patent No.: US 11,193,190 B2
(45) Date of Patent: Dec. 7, 2021

(54) LOW-COST CAST CREEP-RESISTANT AUSTENITIC STAINLESS STEELS THAT FORM ALUMINA FOR HIGH TEMPERATURE OXIDATION RESISTANCE

(71) Applicant: UT-BATTELLE, LLC, Oak Ridge, TN (US)

(72) Inventors: Philip J Maziasz, Oak Ridge, TN (US); Govindarajan Muralidharan, Knoxville, TN (US); Bruce A. Pint, Knoxville, TN (US); Kinga A. Unocic, Knoxville, TN (US); Ying Yang, Farragut, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 0 days.

(21) Appl. No.: 16/510,524

(22) Filed: Jul. 12, 2019

(65) Prior Publication Data

US 2019/0330723 A1 Oct. 31, 2019

Related U.S. Application Data

(63) Continuation-in-part of application No. 16/258,526, filed on Jan. 25, 2019.
(Continued)

(51) Int. Cl.
*C22C 38/42* (2006.01)
*C22C 38/44* (2006.01)
(Continued)

(52) U.S. Cl.
CPC ..... *C22C 38/42* (2013.01); *C22C 38/06* (2013.01); *C22C 38/34* (2013.01); *C22C 38/38* (2013.01); *C22C 38/44* (2013.01); *C22C 38/48* (2013.01)

(58) Field of Classification Search
None
See application file for complete search history.

(56) References Cited

U.S. PATENT DOCUMENTS 2,602,738 A 7/1952 Jennings
2,671,726 A 3/1954 Jennings
(Continued)

FOREIGN PATENT DOCUMENTS

CH 313006 A 3/1956
EP 0340631 A1 11/1989
(Continued)

OTHER PUBLICATIONS

JR. Davis "High-Alloy Cast Steels," ASM Specialty Handbook (Heat-Resistant Materials) (1997), pp. 200-202.
(Continued)

*Primary Examiner* — Anthony J Zimmer
*Assistant Examiner* — Dean Mazzola
(74) *Attorney, Agent, or Firm* — Fox Rothschild LLP

(57) ABSTRACT

An air castable Fe-based stainless steel alloy comprises in weight % based on the total weight of the alloy 18-22% Cr, 15-22% Ni, 3-6% Al, 0.5-5% Mn, 0-3.5% W, 0-5% Cu, 0-2% Si, 1-2.5% Nb, 0.3-0.6% C balance Fe wherein, Cu+W+Si=0.5-10.5, and the alloy provides an oxidation resistance of 0.5<specific mass change<+2 mg/cm$^2$ after 400 one hour cycles at 900° C. in 10% water vapor.

14 Claims, 37 Drawing Sheets

Related U.S. Application Data

(60) Provisional application No. 62/621,638, filed on Jan. 25, 2018.

(51) Int. Cl.

| | |
|---|---|
| ***C22C 38/06*** | (2006.01) |
| ***C22C 38/34*** | (2006.01) |
| ***C22C 38/38*** | (2006.01) |
| ***C22C 38/48*** | (2006.01) |

(56) References Cited

U.S. PATENT DOCUMENTS

| | | | | |
|---|---|---|---|---|
| 2,696,433 | A | 12/1954 | Tanczyn | |
| 2,892,703 | A | 6/1959 | Furman et al. | |
| 3,754,898 | A | 8/1973 | McGurty | |
| 3,969,109 | A | 7/1976 | Tanczyn | |
| 4,086,085 | A | 4/1978 | McGurty | |
| 4,299,623 | A | 11/1981 | Azbukin et al. | |
| 4,560,408 | A | 12/1985 | Wilhelmsson | |
| 4,675,156 | A | 6/1987 | Sakamoto et al. | |
| 4,929,419 | A | 5/1990 | Wegman et al. | |
| 5,147,475 | A | 9/1992 | Holmberg | |
| 5,340,534 | A | 8/1994 | Magee | |
| 5,525,167 | A | 6/1996 | McVicker | |
| 5,536,335 | A | 7/1996 | Burris | |
| 5,595,614 | A | 1/1997 | McVicker | |
| 5,824,264 | A | 10/1998 | Uno et al. | |
| 5,910,223 | A | 6/1999 | Tipton et al. | |
| 6,033,626 | A | 3/2000 | Takahashi | |
| 7,153,373 | B2 | 12/2006 | Maziasz et al. | |
| 7,255,755 | B2 * | 8/2007 | Maziasz | C21D 6/005 148/327 |
| 7,744,813 | B2 | 6/2010 | Brady et al. | |
| 7,754,144 | B2 | 7/2010 | Brady et al. | |
| 7,754,305 | B2 | 7/2010 | Yamamoto et al. | |
| 8,431,072 | B2 * | 4/2013 | Muralidharan | C22C 38/54 420/43 |
| 2003/0084967 | A1 * | 5/2003 | Maziasz | C22C 38/44 148/327 |
| 2012/0301347 | A1 * | 11/2012 | Muralidharan | C22C 33/04 420/36 |
| 2013/0266477 | A1 | 10/2013 | Yamamoto et al. | |

FOREIGN PATENT DOCUMENTS

| | | | |
|---|---|---|---|
| EP | 0467756 | A1 | 1/1992 |
| EP | 0668367 | A1 | 8/1995 |
| GB | 1061511 | A | 3/1967 |

OTHER PUBLICATIONS

J.R. Davis "Metallurgy and Properties of Cast Stainless Steels," ASM Specialty Handbook (Stainless Steels) 1994, pp. 66.

Chen et al, "Development of the 6.8L V10 Heat Resisting Cast-Steel Exhaust Manifold," SAW Technical Paper Series (Oct. 14.

* cited by examiner

LOW-COST CAST CREEP-RESISTANT AUSTENITIC STAINLESS STEELS THAT FORM ALUMINA FOR HIGH TEMPERATURE OXIDATION RESISTANCE

CROSS-REFERENCE TO RELATED APPLICATIONS

This application claims priority to U.S. Provisional Patent Application No. 62/621,638 filed on Jan. 25, 2018 entitled "LOW-COST CAST CREEP-RESISTANT AUSTENITIC STAINLESS STEELS THAT FORM ALUMINA FOR HIGH TEMPERATURE OXIDATION RESISTANCE", and U.S. Non-Provisional patent application Ser. No. 16/258,526 filed on Jan. 25, 2019 entitled "LOW-COST CAST CREEP-RESISTANT AUSTENITIC STAINLESS STEELS THAT FORM ALUMINA FOR HIGH TEMPERATURE OXIDATION RESISTANCE", the entire disclosures of which are incorporated herein by reference.

FIELD OF THE INVENTION

The present invention relates generally to stainless steels, and more particularly to austenitic stainless steels that form alumina for high temperature oxidation resistance.

BACKGROUND OF THE INVENTION

Heat and corrosion resistant stainless steels with high temperature strength and ductility are disclosed in U.S. Pat. No. 7,153,373 (Dec. 26, 2006) and U.S. Pat. No. 7,255,755 (Aug. 14, 2007). Aluminum modified austenitic stainless steels and alloys which are alumina scale formers are disclosed in U.S. Pat. No. 7,744,813 (Jun. 29, 2010) for wrought AFA alloys, U.S. Pat. No. 7,754,144 (Jul. 13, 2010) for high Mn wrought AFA alloys, U.S. Pat. No. 7,754,305 (Jul. 13, 2010) for high Nb, Ta and Al wrought AFA alloys, U.S. Pat. No. 8,431,072 (Apr. 30, 2013) for cast AFA alloys, and US Publ. no. US2013/0266477 (Oct. 10, 2013) for Fe-based AFA wrought superalloys. The disclosure of these references are incorporated fully by reference herein. Generally the wrought AFA alloys have about 3-4% Al or less, and form alumina scales for oxidation resistance up to about 900° C., while the cast AFA alloys can form protective alumina scale at up to 1100° C. These alloys often have about 30-35% Ni, so they tend to be 2-3 times more costly than austenitic stainless steels with 15-20% Ni. There is a need for a low-cost stainless steel alloy with good alumina scale formation up to 1000° C., particularly for automotive exhaust manifolds and turbocharger housings. While many other industries will benefit from such stainless steel alloys with good oxidation, moisture-enhanced oxidation, carburization and coking resistance as well creep resistance, recently a particular need has been in the turbocharger industry, especially for gasoline combustion engine passenger vehicle applications. High temperature alumina forming steel alloys are very advantageous for moving parts such as vanes and gates in advanced turbo-technologies.

SUMMARY OF THE INVENTION

An air castable Fe-based stainless steel alloy comprises in weight % based on the total weight of the alloy:

18-22% Cr
15-22% Ni
3-6% Al
0.5-5% Mn 0-3.5% W
0-5% Cu
0-2% Si
1-2.5% Nb
0.3-0.6% C balance Fe wherein, Cu+W+Si=0.5-10.5, and the alloy provides an oxidation resistance of 0.5<specific mass change<+2 mg/cm$^2$ after 400 one hour cycles at 900° C. in 10% water vapor.

The alloy can further include 0-2% Ta. The alloy can have Ta+Nb<4.0. The ratio of Ta/Nb=0-0.75. The alloy can further comprise 0.1-5.0% Co. The Cu/W ratio can be 0.75-1.67. The ratio of Nb/C can be from 2-5.

The alloy can be non-magnetic and free of alpha or delta ferrite phases, and does not form a thermal or strain induced martensite phase.

The content of N can be less than 0.1. The ratio of Cr/Al can be 4.7-8 and the Cr/(Al+Si) ratio can be 2.25 to 6.15.

The alloy can provides an oxidation resistance of −2<mass change<+2 mg/cm$^2$ after 300 one hour cycles at 950° C. in 10% water vapor.

BRIEF DESCRIPTION OF THE DRAWINGS

There are shown in the drawings embodiments that presently preferred it being understood that the invention is not limited to the arrangements and instrumentalities shown, wherein:

FIG. 1 shows that Al-modified CF8C-Plus steel of the invention shows good creep resistance at 1000 and 1050° C.

FIG. 5 is a BSE-SEM of microstructure of as cast Al2+ showing different regions of interdendritic precipitation in the parent austenite phase.

DETAILED DESCRIPTION OF THE INVENTION

The alloys of the invention comprise low-cost (lower Ni) austenitic stainless steel alloyed to have a stable austenite parent phase structure with enough aluminum added to the alloy to enable it to form protective alumina oxide scales at 1000° C. and above, and still have the required creep and tensile strength demanded for structural component applications. The alloys of the invention are austenitic stainless steel wherein nano-scale dispersions of carbide (and nitride in some cases) precipitates provide the basis for creep rupture resistance at up to 1000° C. The solute additions provide good tensile strength and ductility at 900-1100° C.

The alloys of the invention are austenitic parent phase alloy that is non-magnetic and free of alpha or delta ferrite phases, and which does not form a thermal or strain-induced martensite. The Ni, Mn, W, Mo, Cu, Si, Nb, Ta, C, N, and Al alloying additions strengthen the solid-solution austenite parent phase, as well as interact to produce a variety of micro- and nano-scale carbides and nitrides (and possibly Cu rich particles in some cases), which then directly provide high-temperature strength and creep resistance by pinning dislocations.

The Cr, Al and Si additions of the alloys of the invention interact in a complex and synergistic way to form the protective oxide scales that give this invention alloy its oxidation resistance. Ta has a propensity to form fine TaN precipitate dispersions, in addition to the expected formation of TaC precipitates. One of the microstructural design features of the alloys of the invention is that Ta should help refine the formation of AlN precipitates if the alloy has added N. The W can help to stabilize the $M_{23}C_6$ carbide phase, as well as possibly form W-rich WC carbides, in addition to strengthening the solid solution parent austenite phase; however, W is not needed for the invention alloys. Niobium additions are intended to form fine, stable dispersions of NbC and $(Nb,Cr)_2N$. Copper additions can cause precipitation of Cu particles at temperatures of 900° C. and below, if it is added, but the invention alloys do not require Cu. The carbide and nitride dispersions can help to strengthen the invention alloys at 1000° C. and above. Additions of 3.5-5.5% Al will produce the formation of compact, adherent, and protective alumina oxide scales at 700-1000° C. The alloys of the invention can be air-cast with an argon or other suitable cover gas to prevent Al from oxidizing during casting and excessive nitride formation.

The alloys of the invention provide creep rupture resistance of 2500 h at 850° C./50 MPa, and 500 h at 900° C./50 MPa, and 900 h at 950° C./35 MPa, and up to 1000° C., and good tensile strength of 10-20 kpsi and ductility of 30-40% at 900° C. to 1000° C. and high temperature oxidation resistance.

Figure 1:
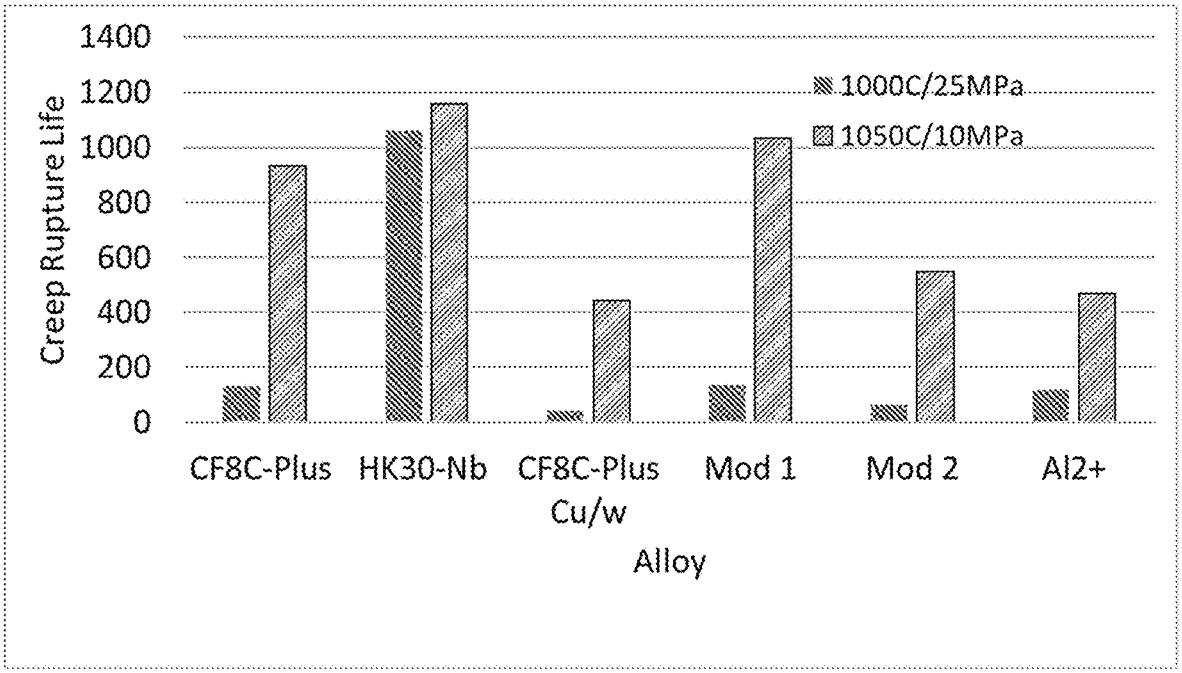
FIG. 1 shows a graph of creep rupture life (h) vs. creep rupture tested steels at 1000° C./25 MPa and 1050° C./10 MPa.
Figure 2:
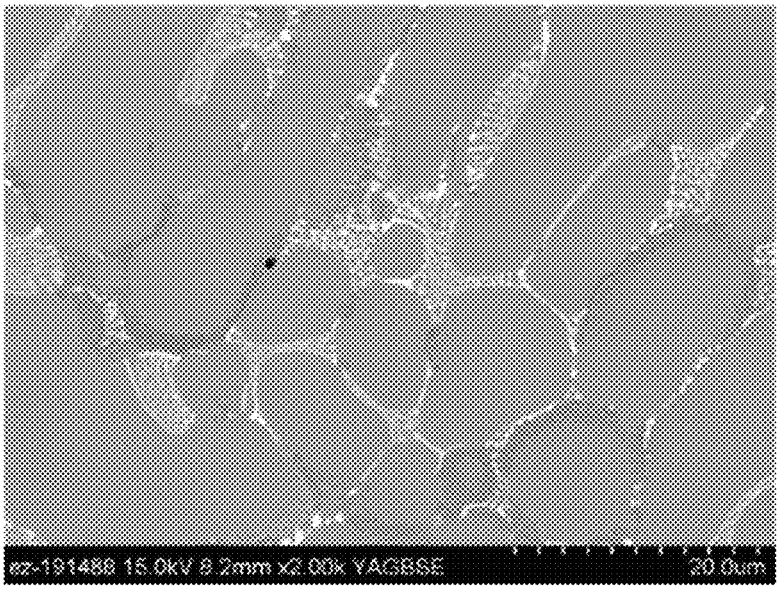
FIG. 2 shows a SEM back-scattered image showing the as-cast interdendritic structure of NbC (bright) and Ni-rich superalloy regions with internal $Ni_3Al$ precipitation (darker).
Figure 3:
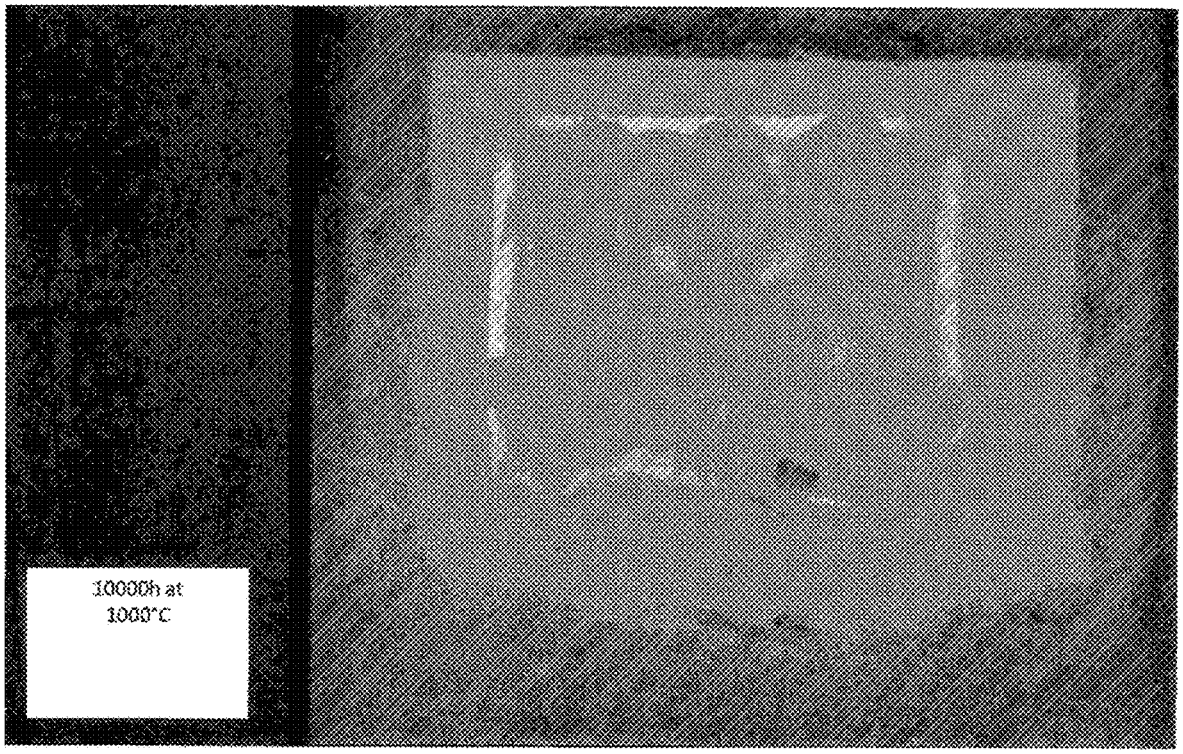
FIG. 3 shows an image showing that oxidation in air is catastrophic at 1000° C. after 10000 h.
Figure 4:
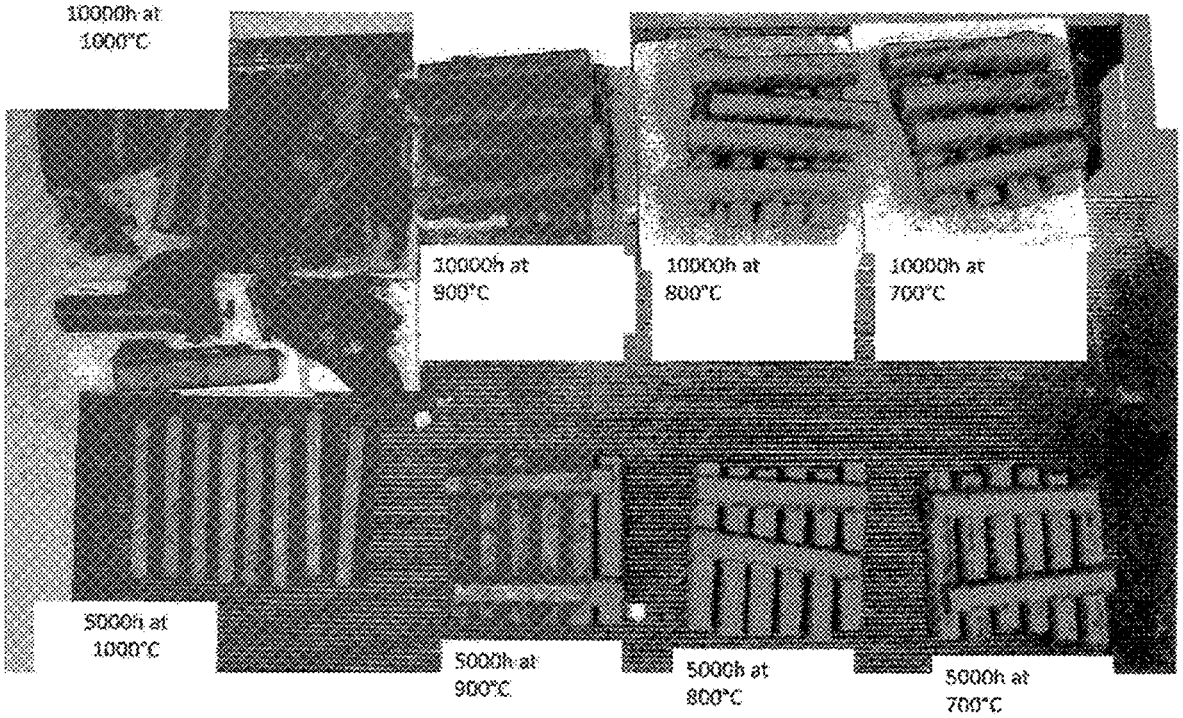
FIG. 4 shows an image of multiple specimens demonstrating that oxidation in air is catastrophic at 1000° C. after 10,000 h. Metals like cast CF8C-Plus steel survives at 900° C., but long term oxidation at 950° C. is severe. For automotive exhaust components used at 800-950° C., oxidation is a concern. Exhaust materials degrade due to oxidation in water vapor at 800° C. and above and loose strength dramatically at 900° C. and above.
Figure 5:
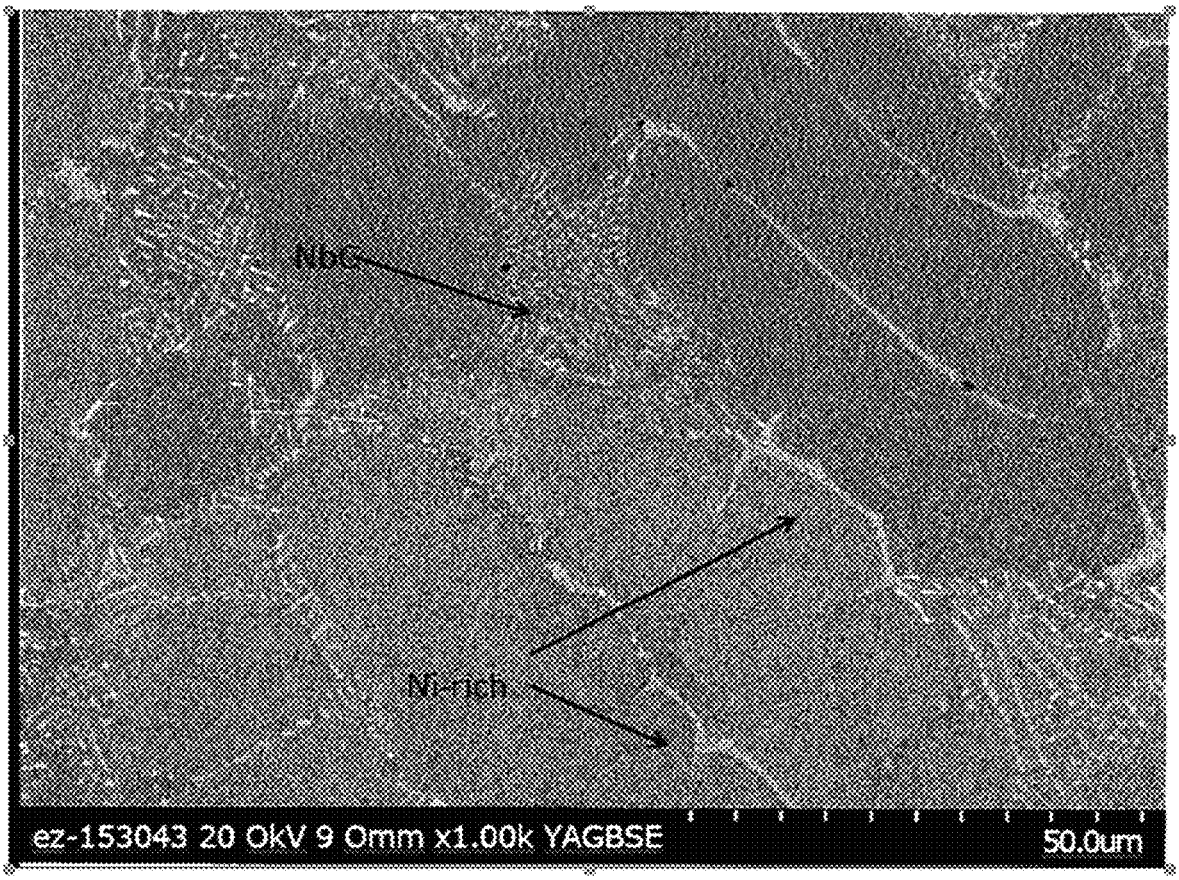
FIG. 5 shows that Al-mod CF8C-Plus steel of the present invention has interdendritic NbC and Ni-rich regions with fine precipitates.
Figure 6:
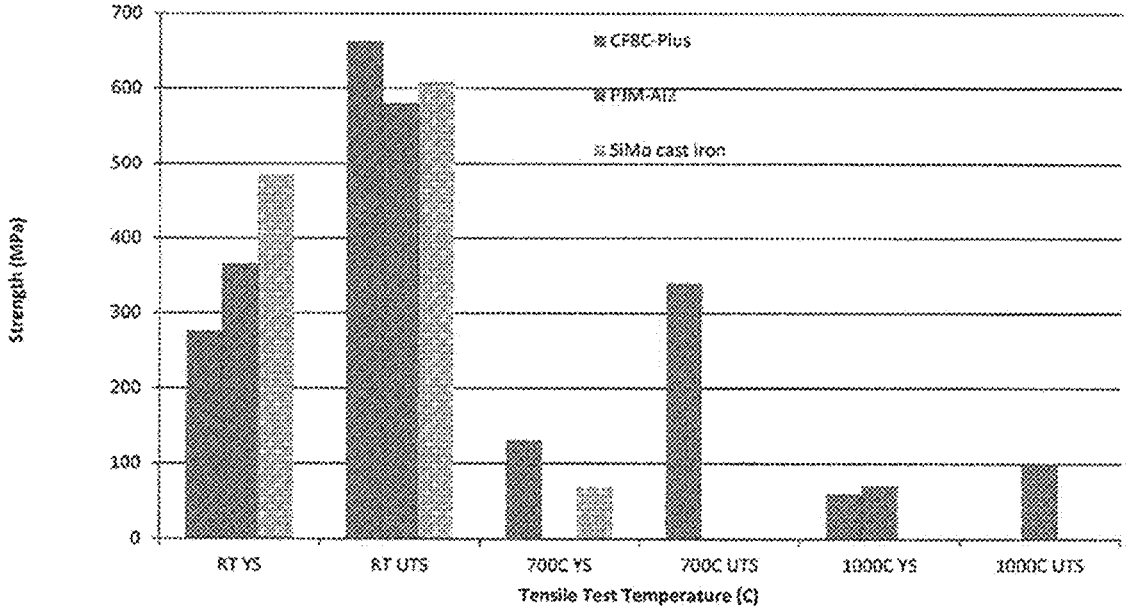
FIG. 6 shows a graph of yield strength and ultimate tensile strength (MPa) vs. tensile test temperature (C) for CF8C-Plus, Al2+ (PJM-AL2) and SiMo cast iron.
Figure 7:
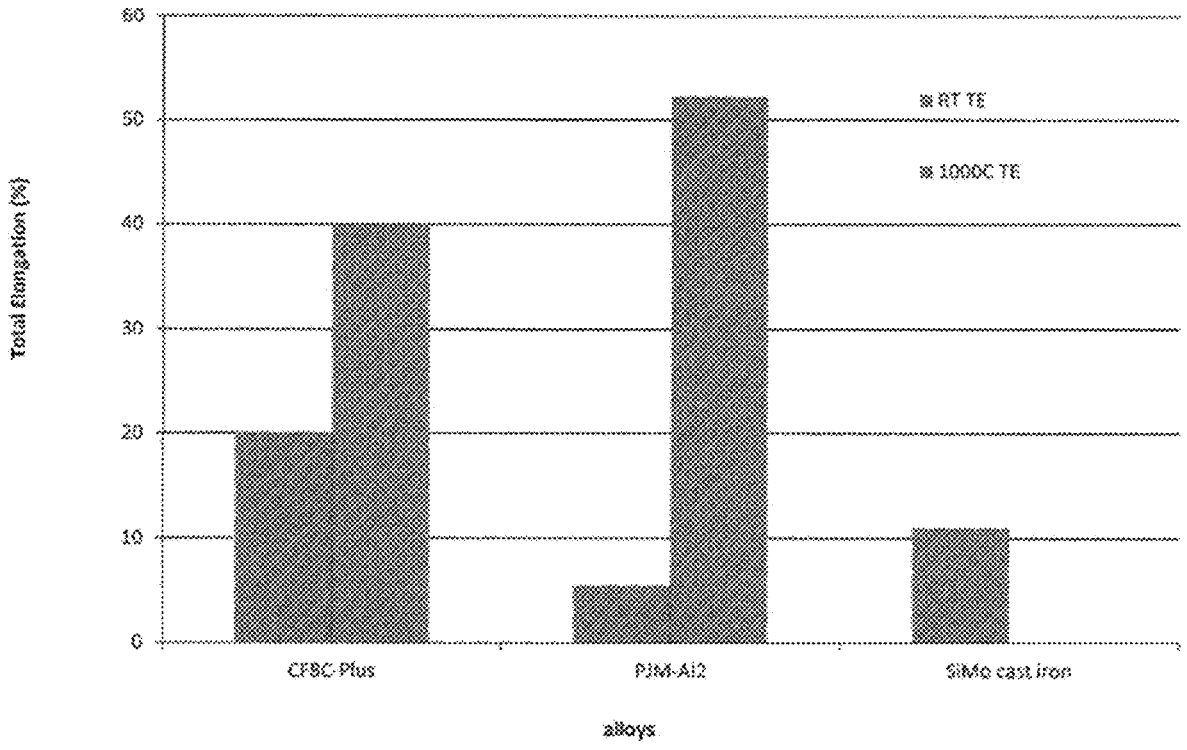
FIG. 7 shows a graph of total elongation (%) vs. alloys CF8C-Plus, Al2+ (PJM-Al2), and SiMo cast iron at Room Temperature, and 1000° C.
Figure 8:
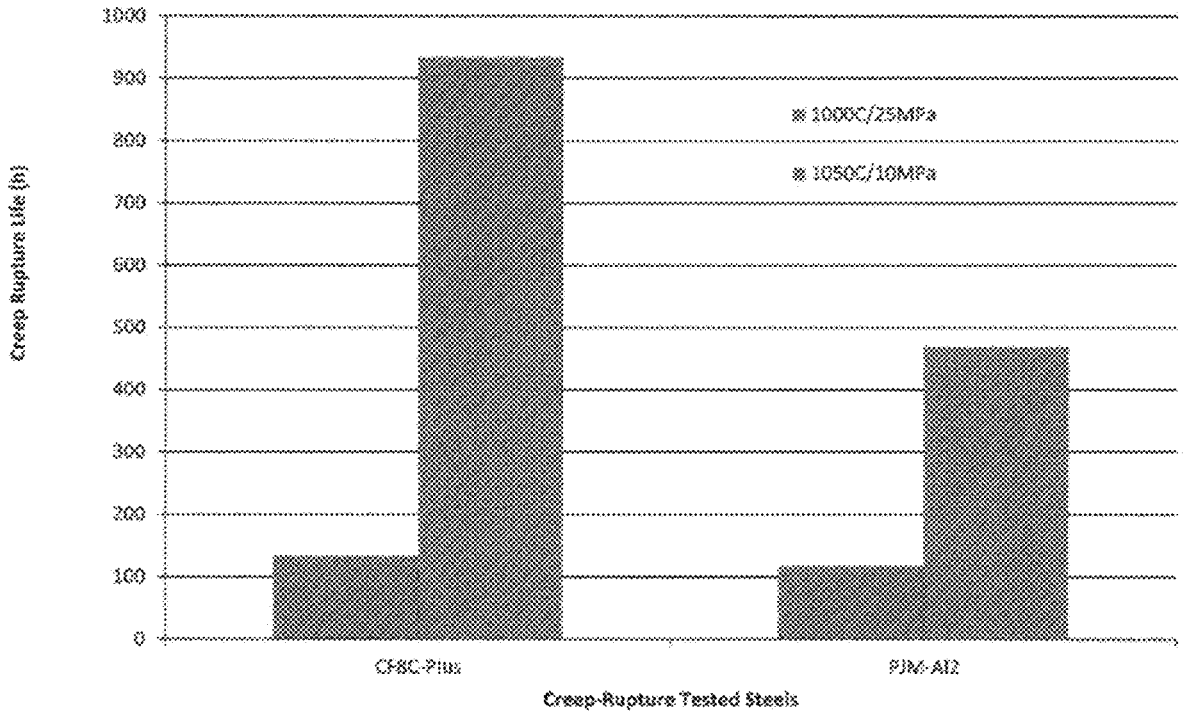
FIG. 8 shows a graph of creep rupture life (h) vs. creep-rupture tested steels CF8C-Plus and Al2+ (PJM-Al2) at 1000° C./25 MPa and 1050° C./10 MPa.
Figure 9:
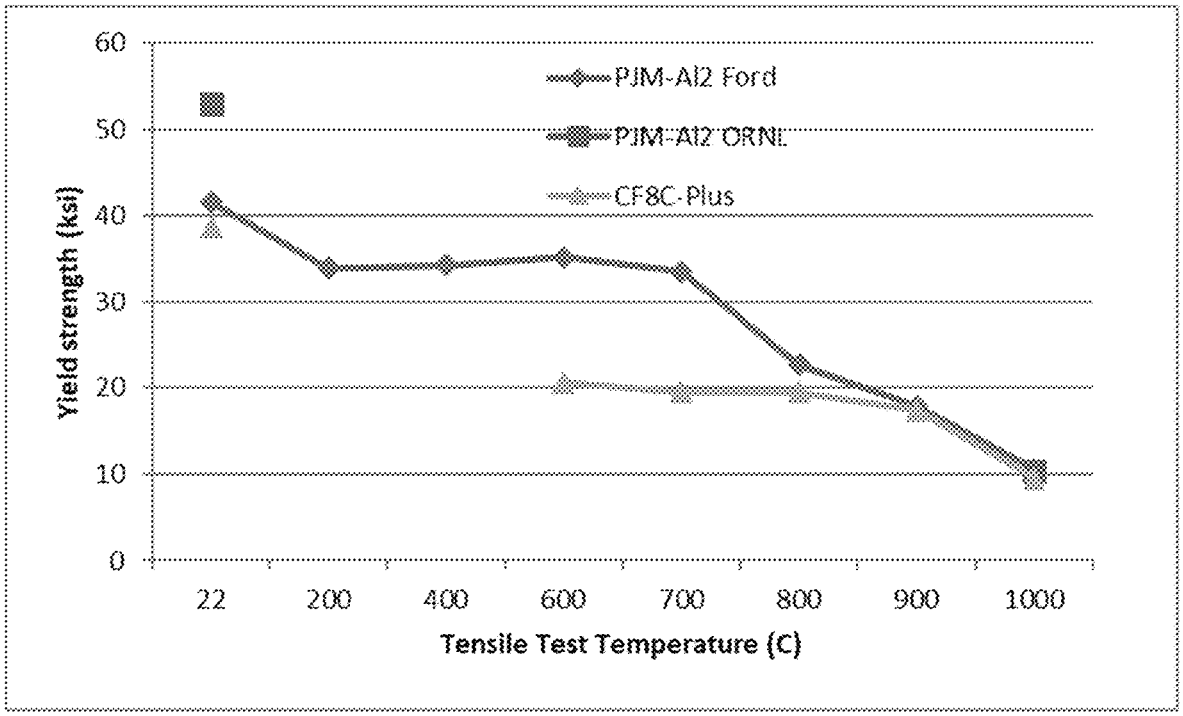
FIG. 9 shows a graph of yield strength (ksi) vs. tensile test temperature (° C.) for Al2+ (PJM-Ford), Al2+ (ORNL), and CF8C-Plus.
Figure 10:
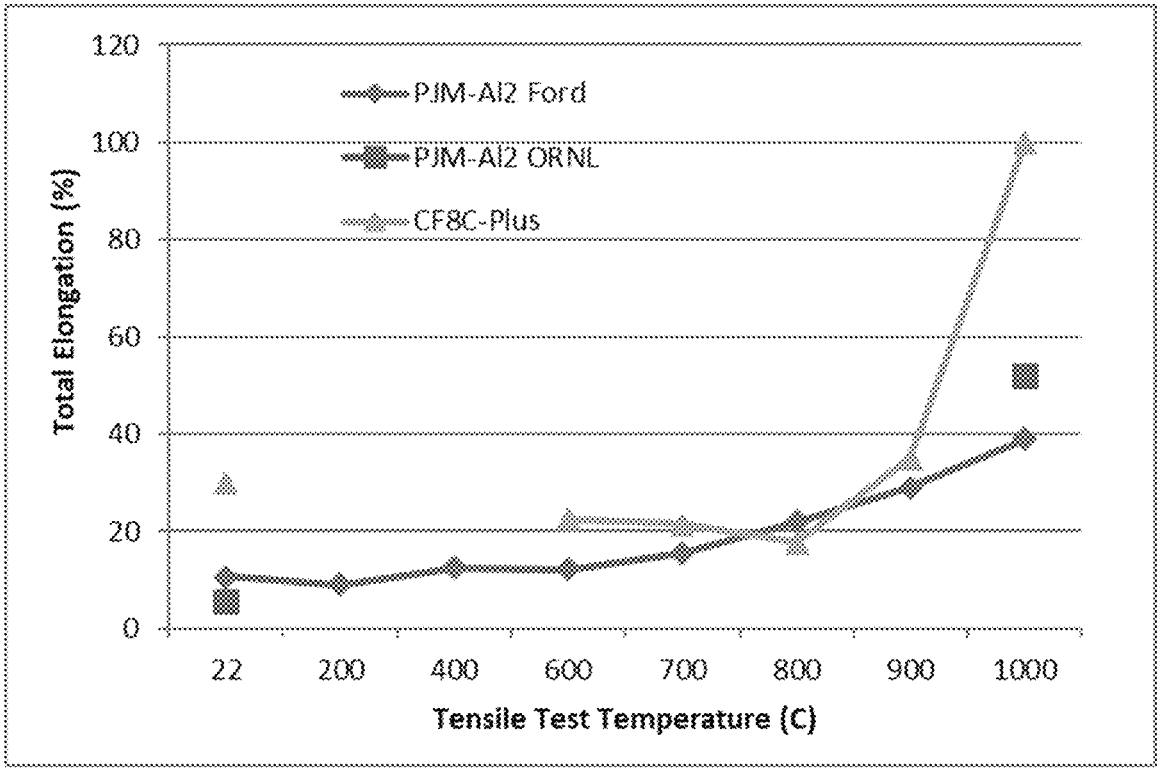
FIG. 10 shows a graph of total elongation (%) vs. tensile test temperature (C) of Al2+ (PJM-Al2 ORNL, PJM-Ford)
Figure 11:
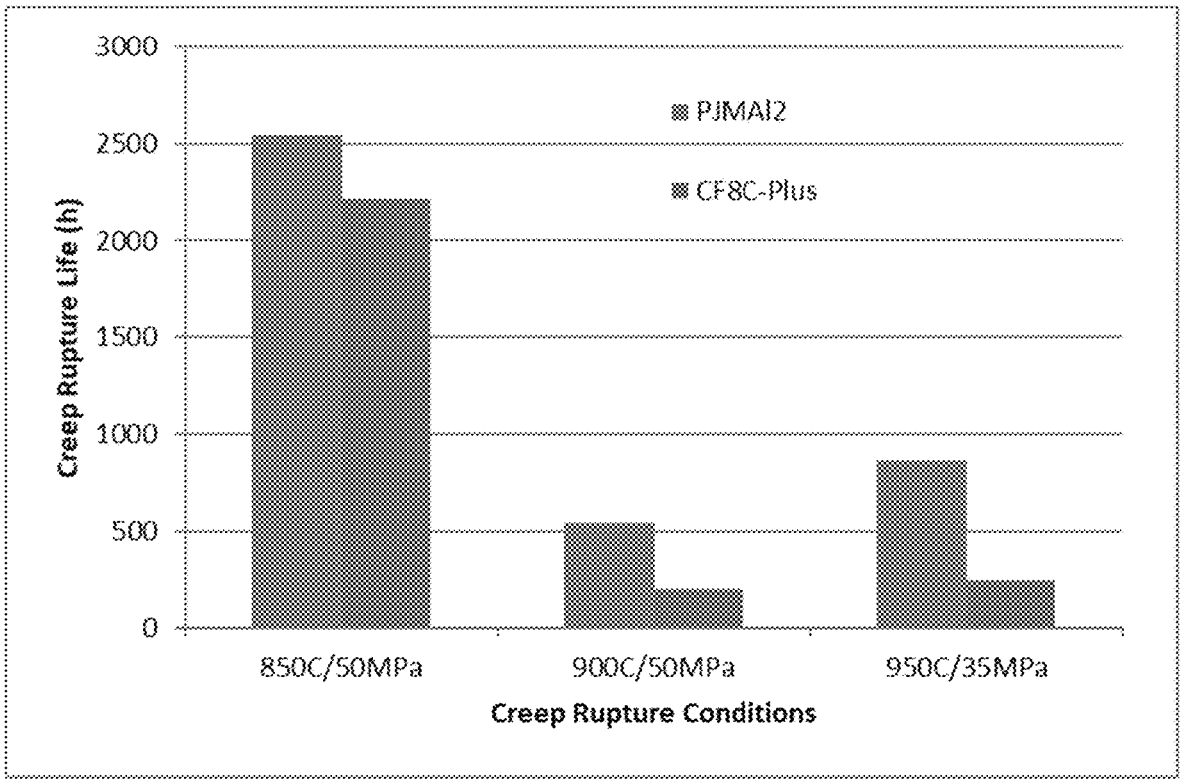
FIG. 11 shows a graph of creep rupture life (h) vs. creep rupture conditions 850° C./50 MPa, 900° C./50 MPa, and 950° C./35 MPa for Al2+ (PJMA12) and CF8C-Plus.
Figure 12:
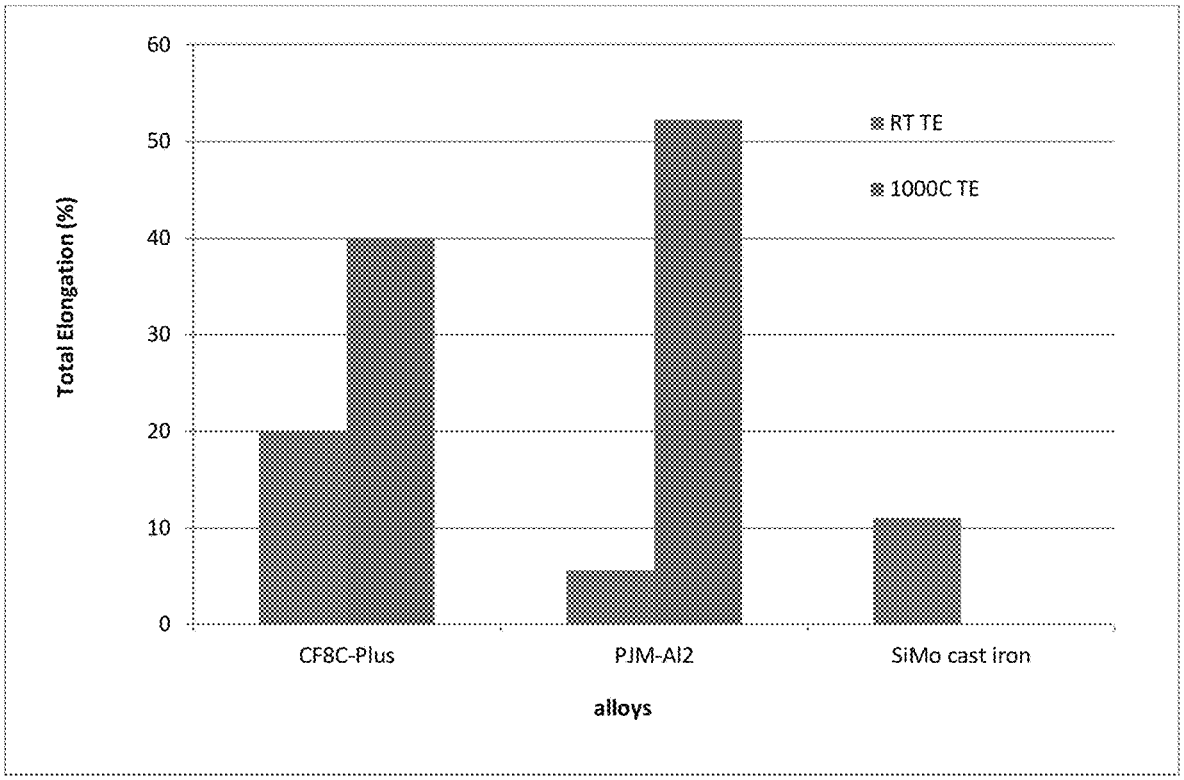
FIG. 12 shows a graph of total elongation (%) vs. alloys at Room Temperature and 1000° C.
Figure 13:
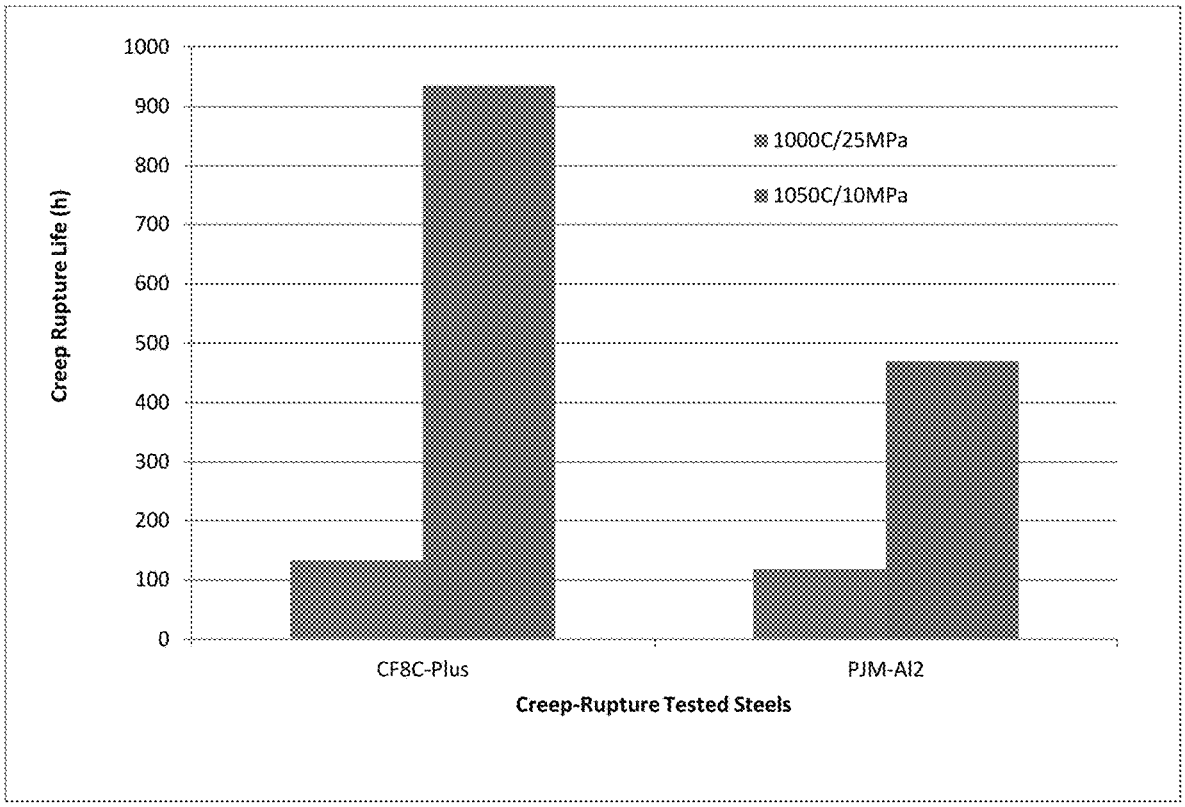
FIG. 13 shows a graph of creep rupture life (h) vs. creep-rupture tested steels CF8C-Plus and Al2+ (PJM-Al2) at 1000° C./25 MPa and 1050° C./10 MPa.
Figure 14:
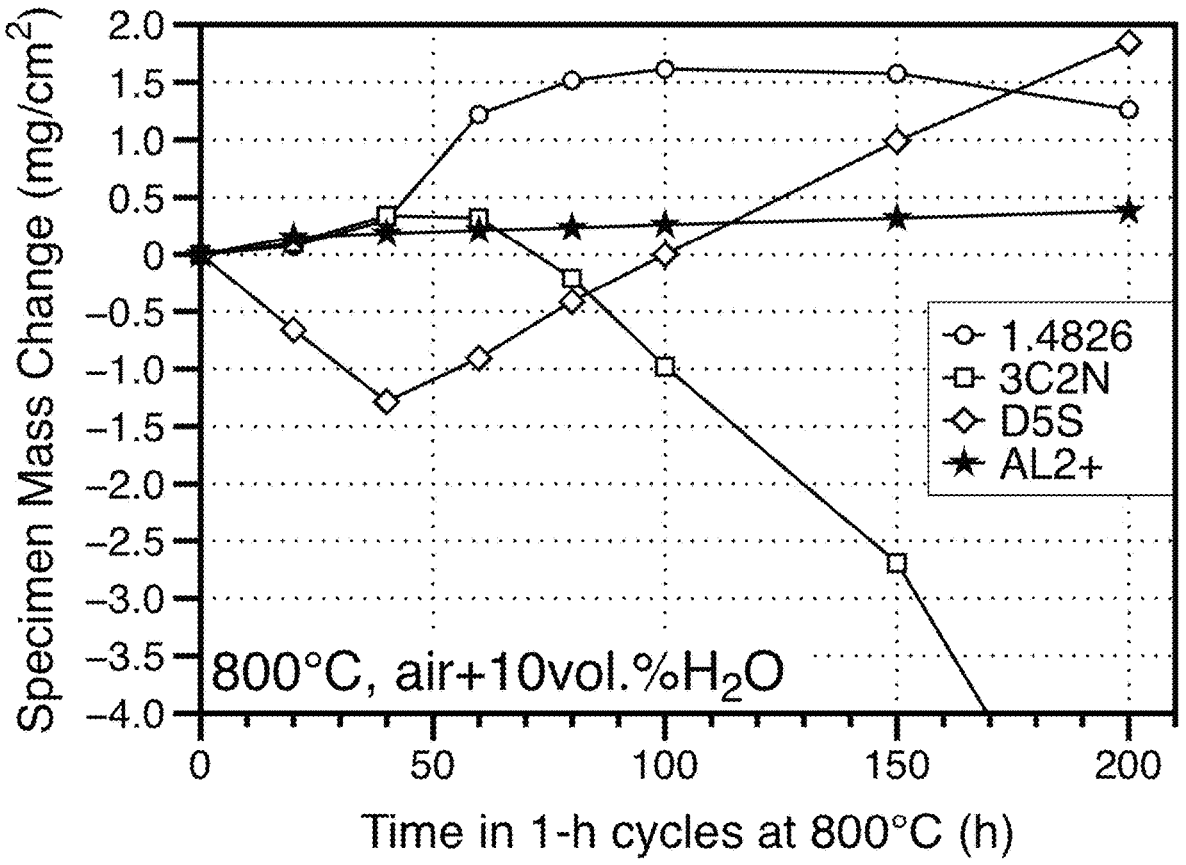
FIG. 14 shows a graph of specimen mass change (mg/$cm^2$) vs. Time in 1-h cycles at 800° C. (h) for 1.4826, 3C2N, D5S and AL2+. Note that a small positive mass change indicates a slow growing oxide scale and is desirable. A negative mass change indicates mass loss due to spallation or volatilization of the oxide scale and is undesirable. Note that AL2+ shows a small positive mass gain in this test.
Figure 15:
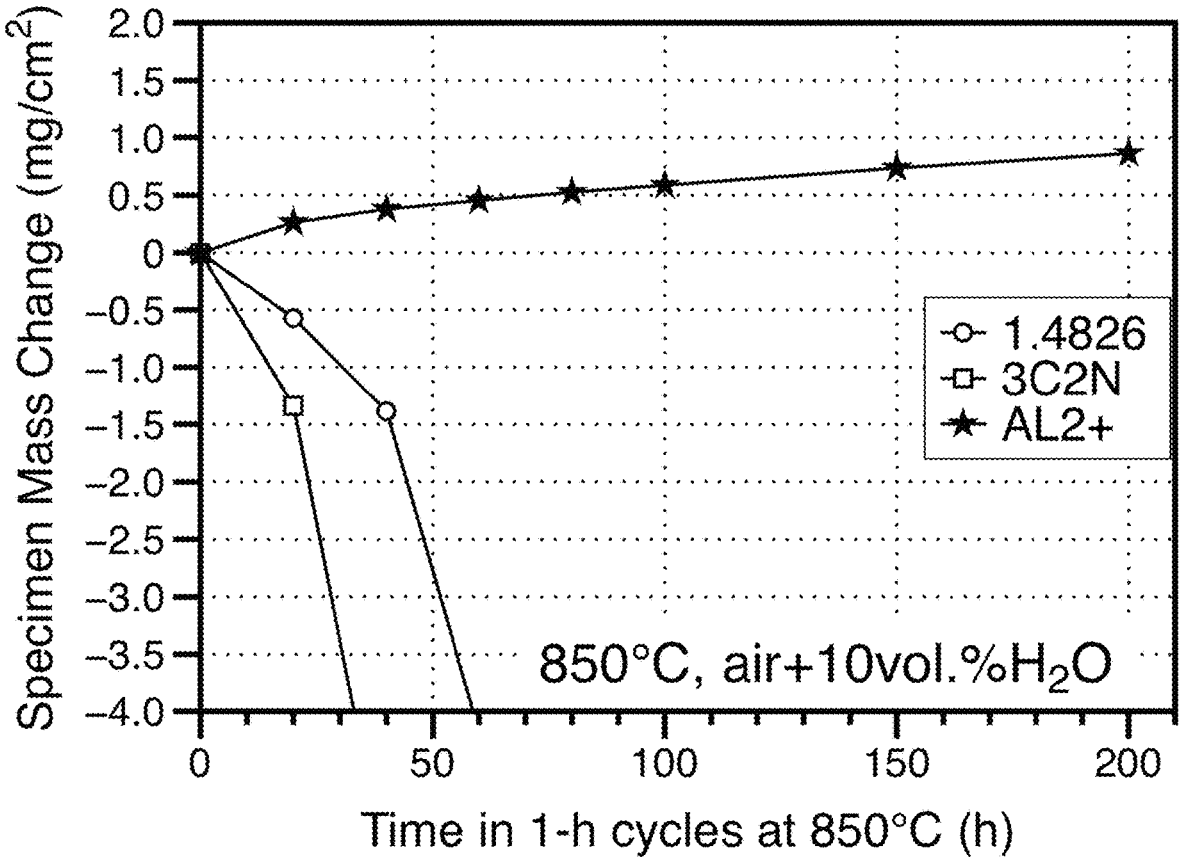
FIG. 15 shows a graph of specimen mass change (mg/$cm^2$) vs. Time in 1-h cycles at 850° C. (h) for 1.4826, 3C2N and AL2+. Note that AL2+ shows a small positive mass gain in this test while competing alloys show large negative mass change which is undesirable.
Figure 16:
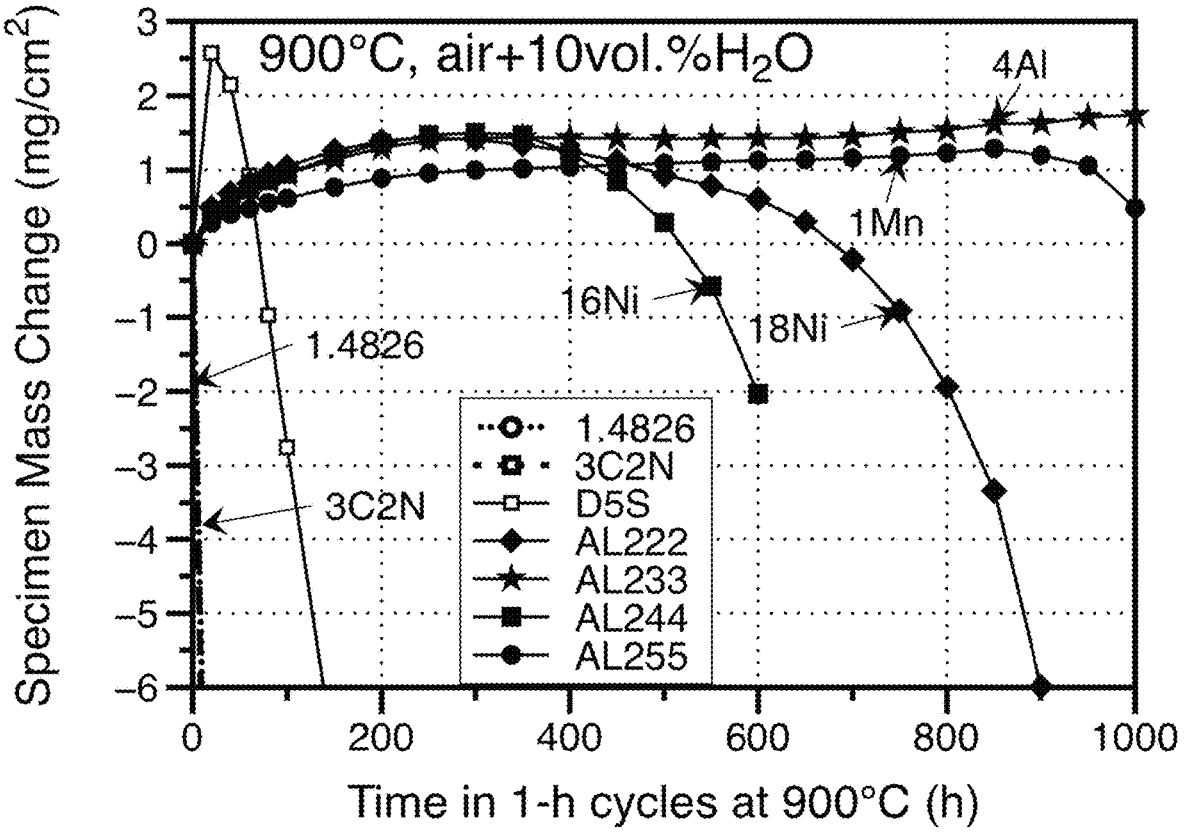
FIG. 16 shows a graph of specimen mass change (mg/$cm^2$) vs. Time in 1-h cycles at 900° C. (h) for 1.4826, 3C2N, D5S, AL222. AL233, AL244 and AL255. Note that the alloys of the invention show small positive mass gains for extended period of time while the chromia formers (1.4826 and 3C2N) show undesirable large negative mass change. Note that the oxidation resistance improves with increasing Ni contents from 16Ni (Al244) to 20Ni(Al255).
Figure 17:
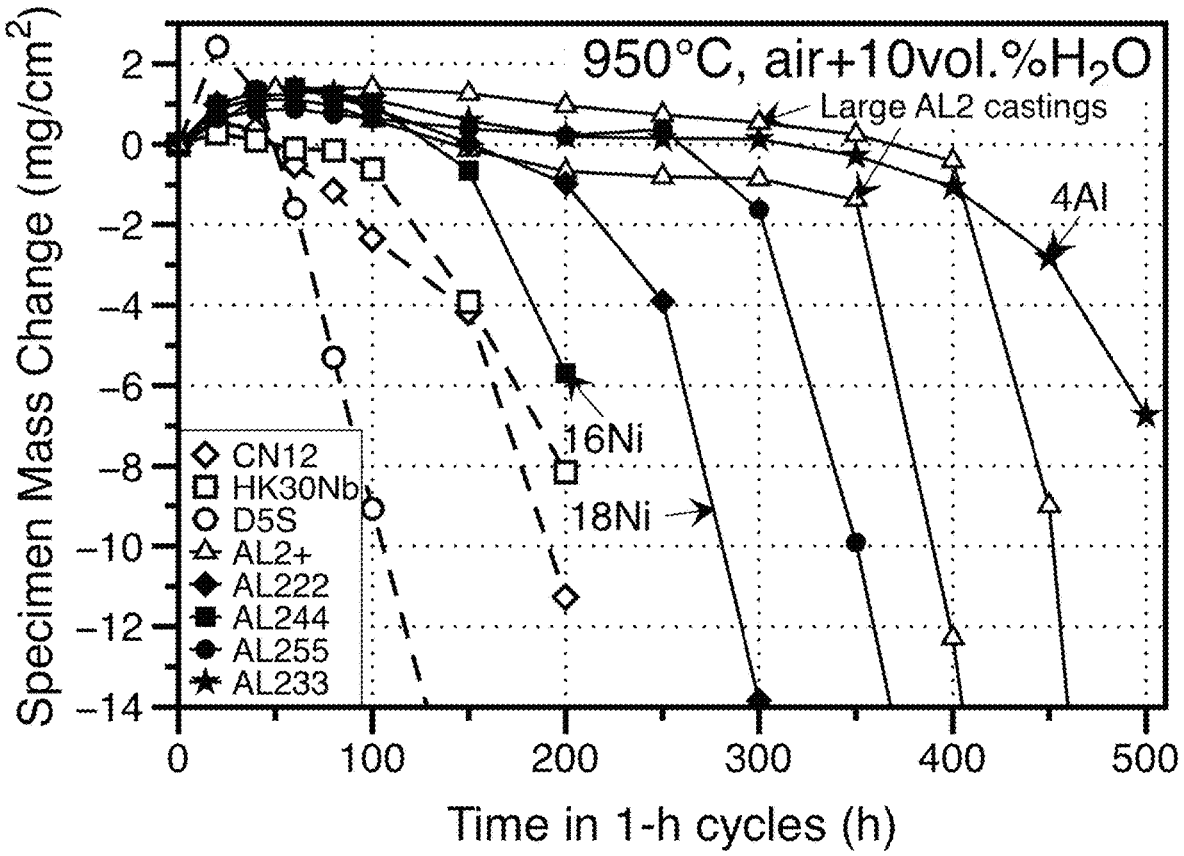
FIG. 17 shows a graph of specimen mass change (mg/$cm^2$) vs. Time in 1-h cycles (h) for CN12, HK30Nb, D5S, AL2+, AL222. AL233, AL244 and AL255. Note that the alloys of the invention show positive mass gain for extended periods of time indicating good oxidation behavior in this stage of the test.
Figure 18:
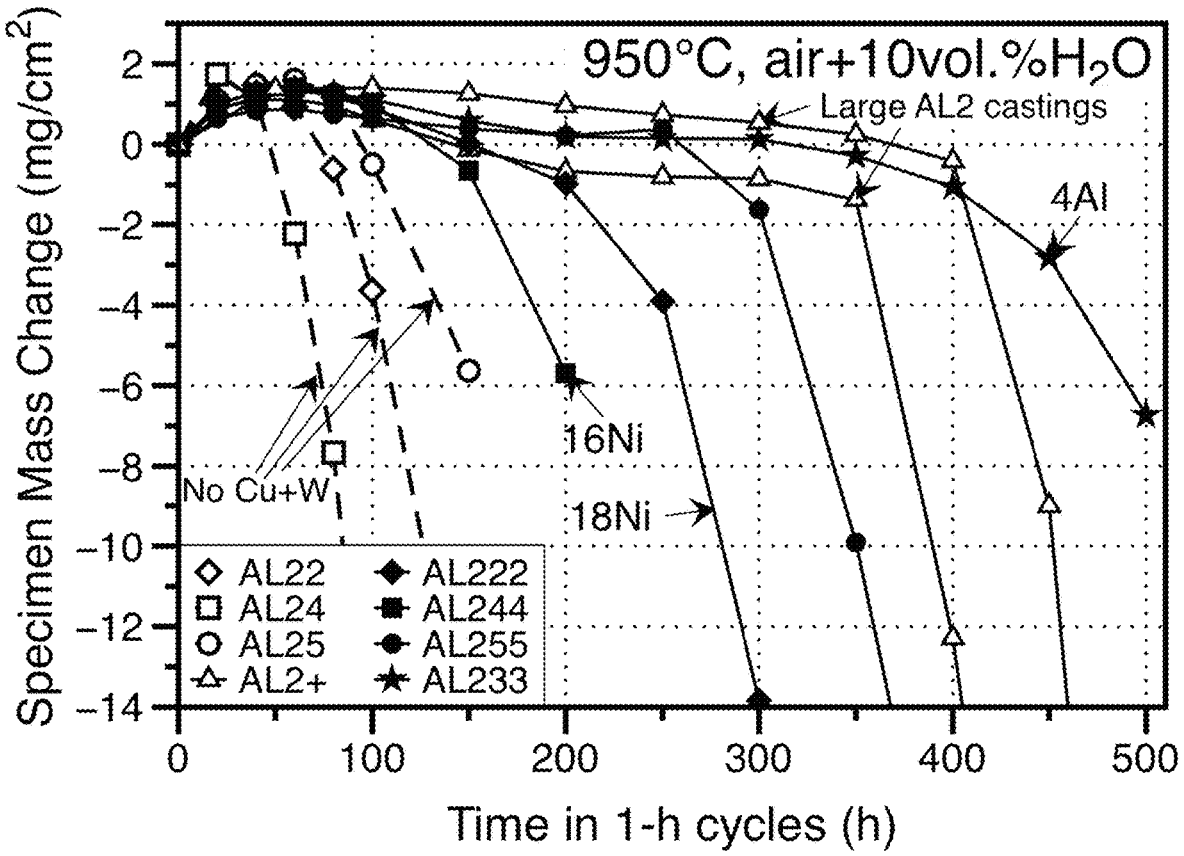
FIG. 18 shows a graph of specimen mass change (mg/$cm^2$) vs. Time in 1-h cycles (h) for AL22, AL24, AL25, AL2+, AL222. AL233, AL244 and AL255.
Figure 19:
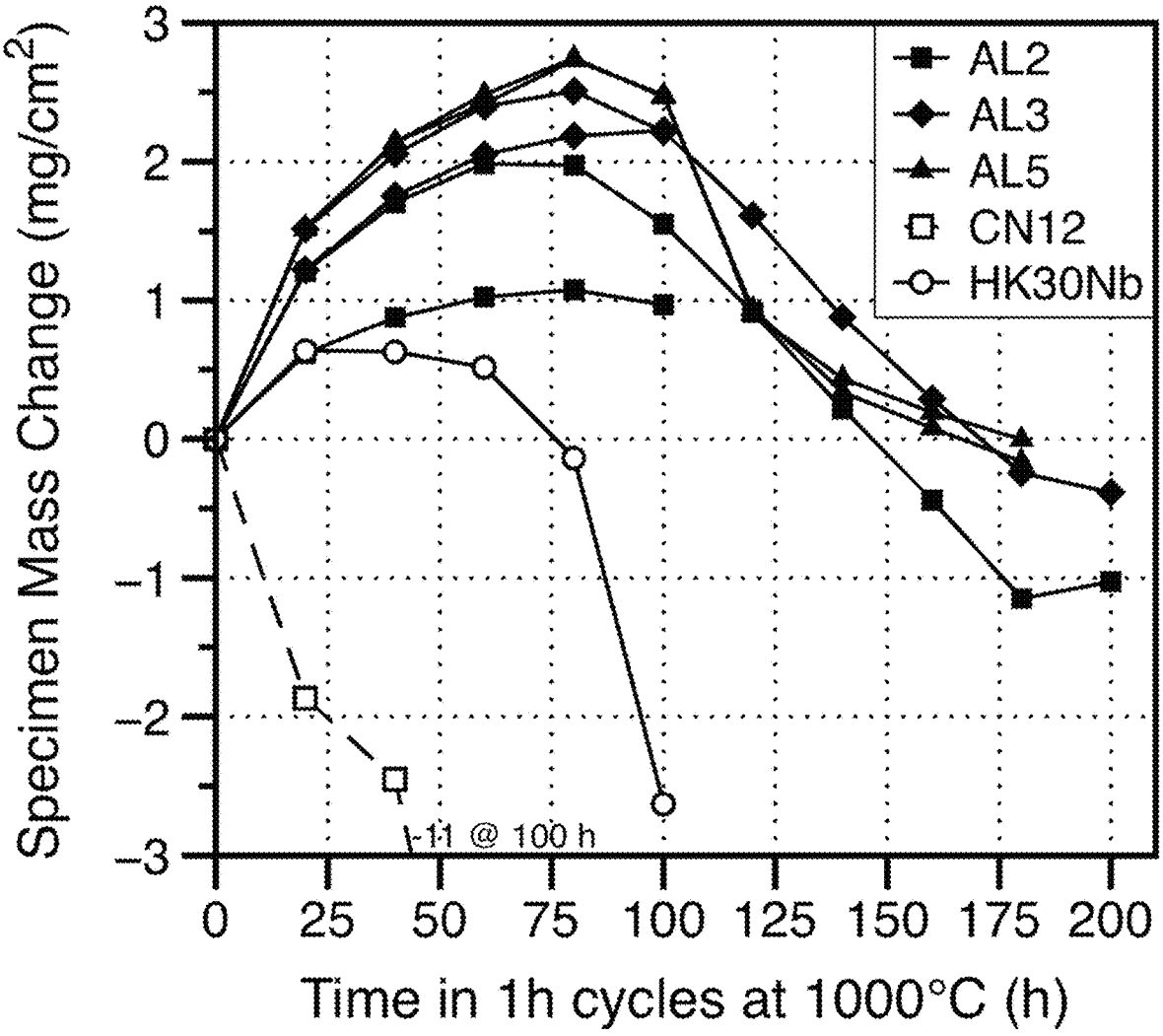
FIG. 19 shows a graph of graph of specimen mass change (mg/$cm^2$) vs. Time in 1-h cycles at 1000° C. (h) for AL2, AL3, AL4, CN5, CN12 and HK30Nb.
Figure 20:
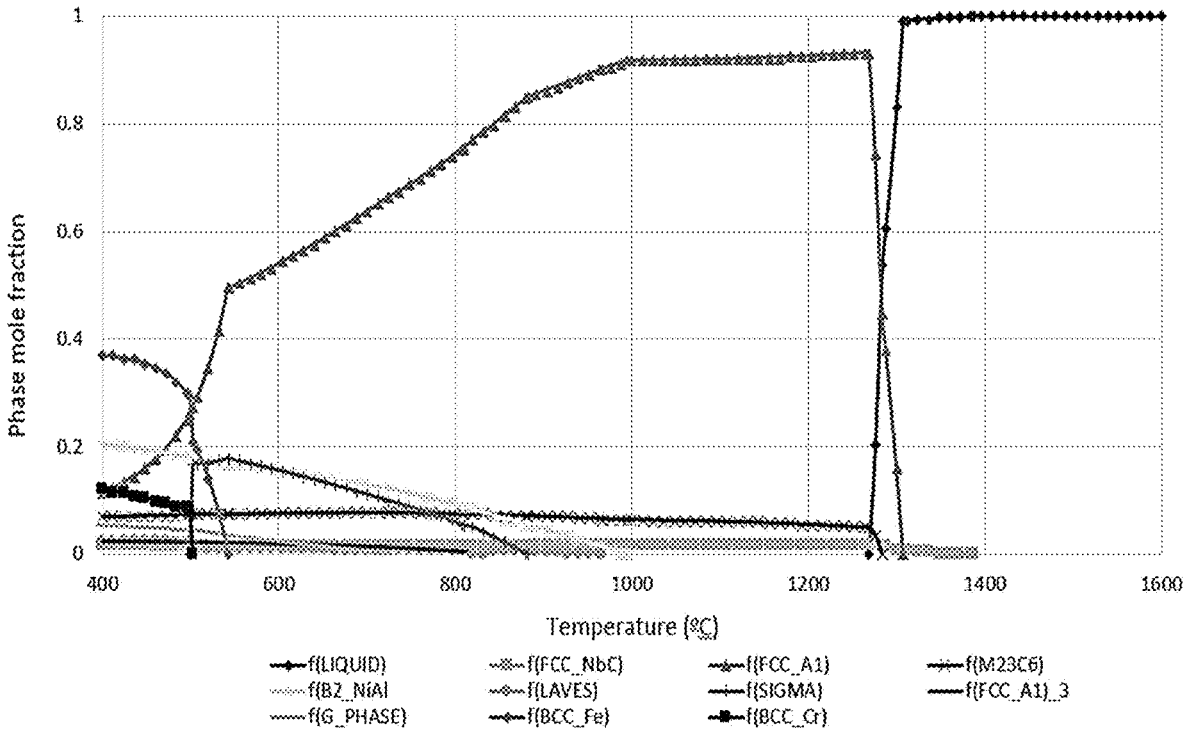
FIG. 20 shows a plot of phase mole fraction vs. temperature (° C.) for Alloy 2-1.
Figure 21:
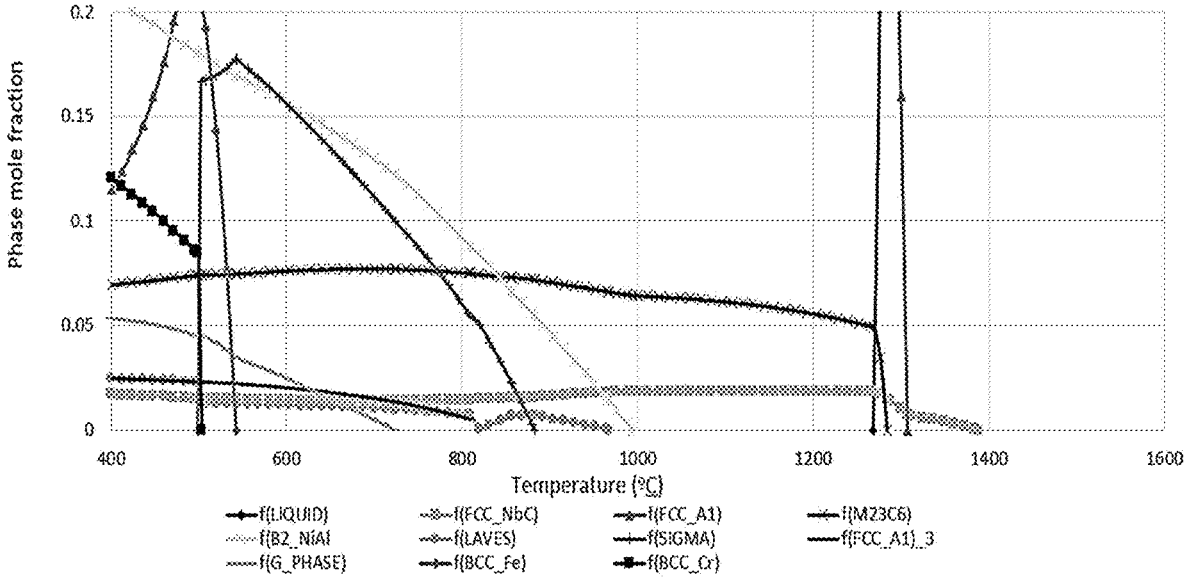
FIG. 21 shows a zoomed in plot of phase mole fraction vs. temperature (° C.) for Alloy 2-1.
Figure 22:
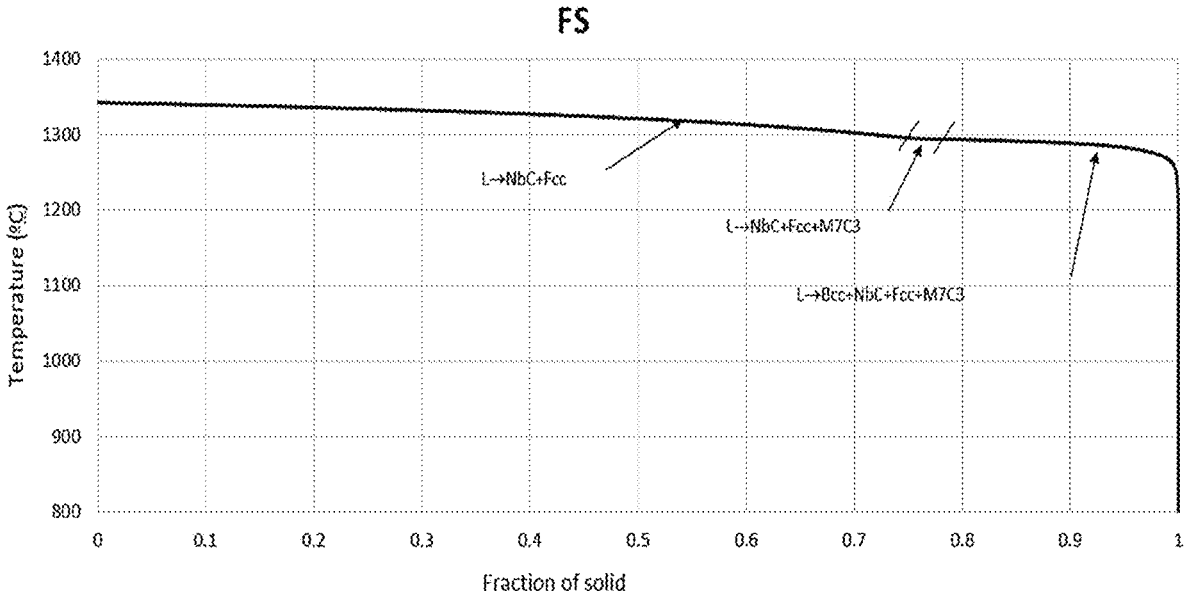
FIG. 22 shows a plot of temperature (° C.) vs. fraction of solid for Alloy 2-1 during solidification.
Figure 23:
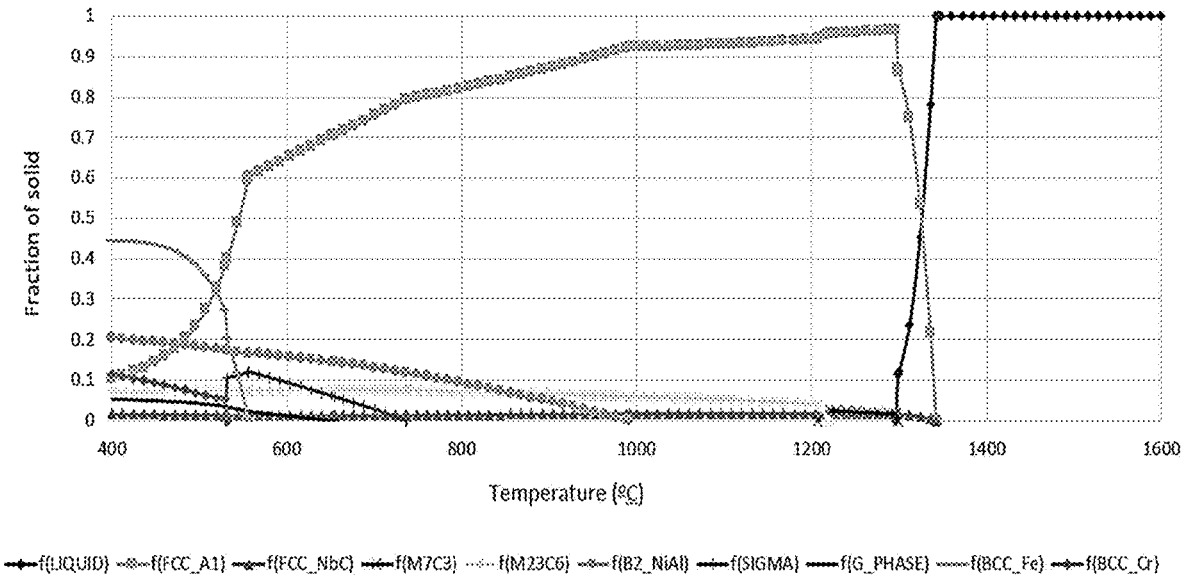
FIG. 23 shows a plot of fraction of solid vs. temperature (° C.) of solid for Alloy 2.1-1.
Figure 24:
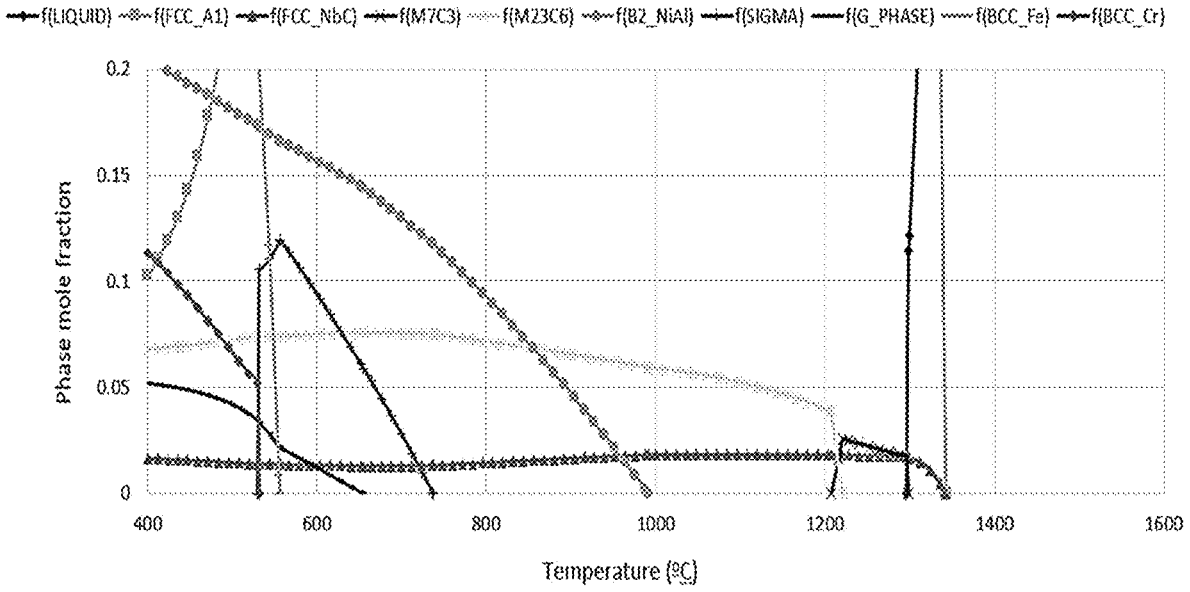
FIG. 24 shows a zoomed in plot of phase mole fraction vs. temperature (° C.) for Alloy 2.1-1.
Figure 25:
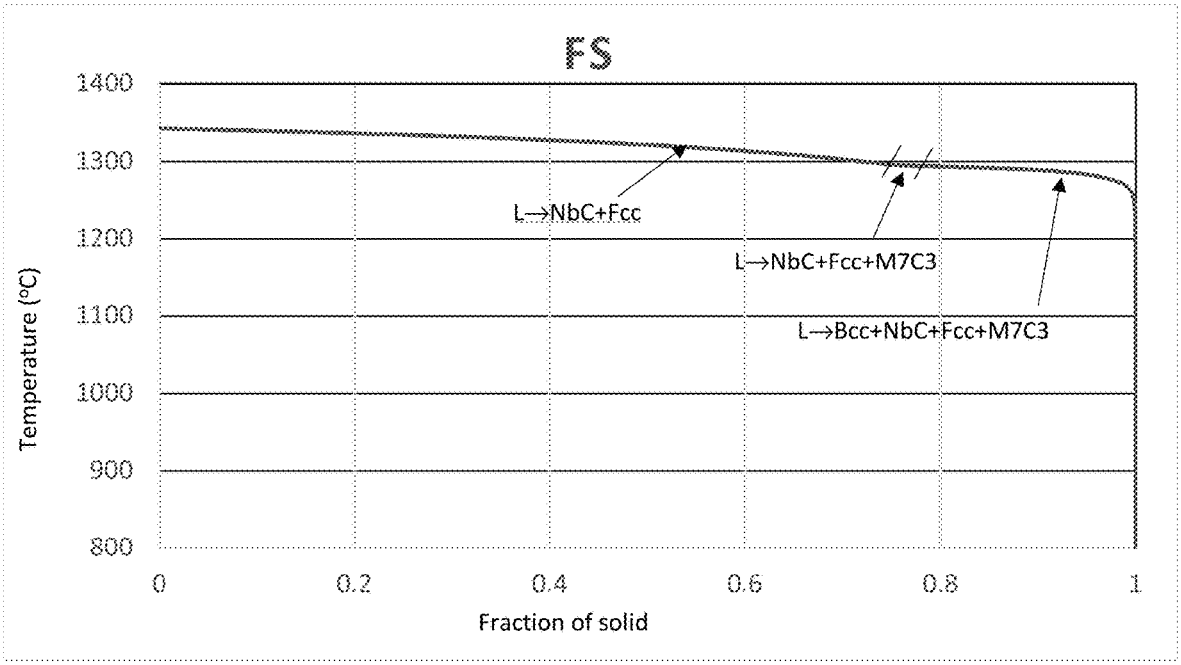
FIG. 25 shows a plot of of temperature (° C.) vs. fraction of solid for Alloy 2.1-1 during solidification.
Figure 26:
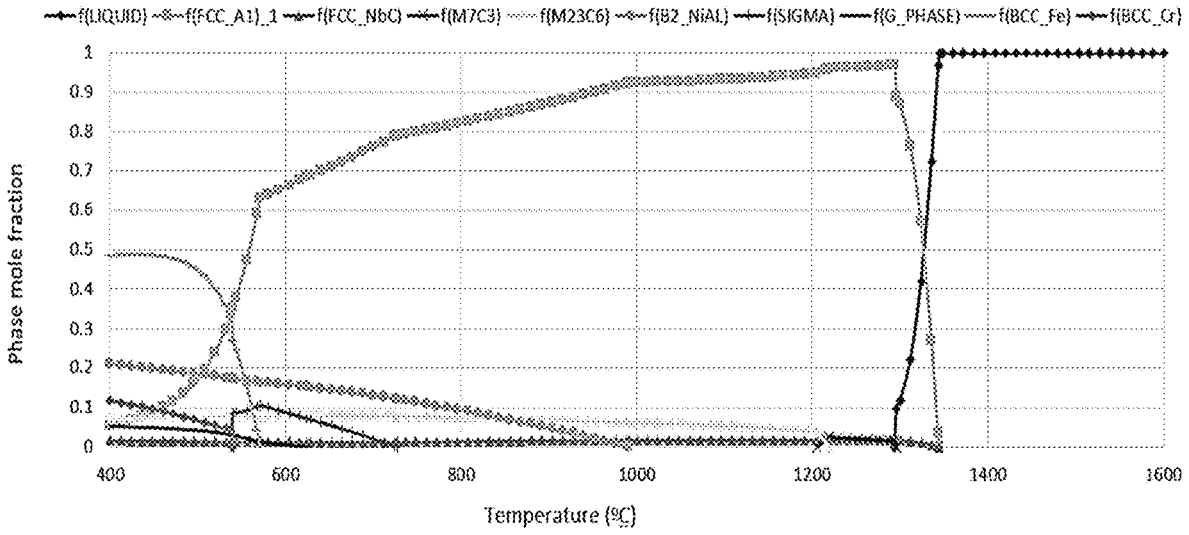
FIG. 26 shows a plot of phase mole fraction vs. temperature (° C.) for Alloy 2.2-1.
Figure 27:
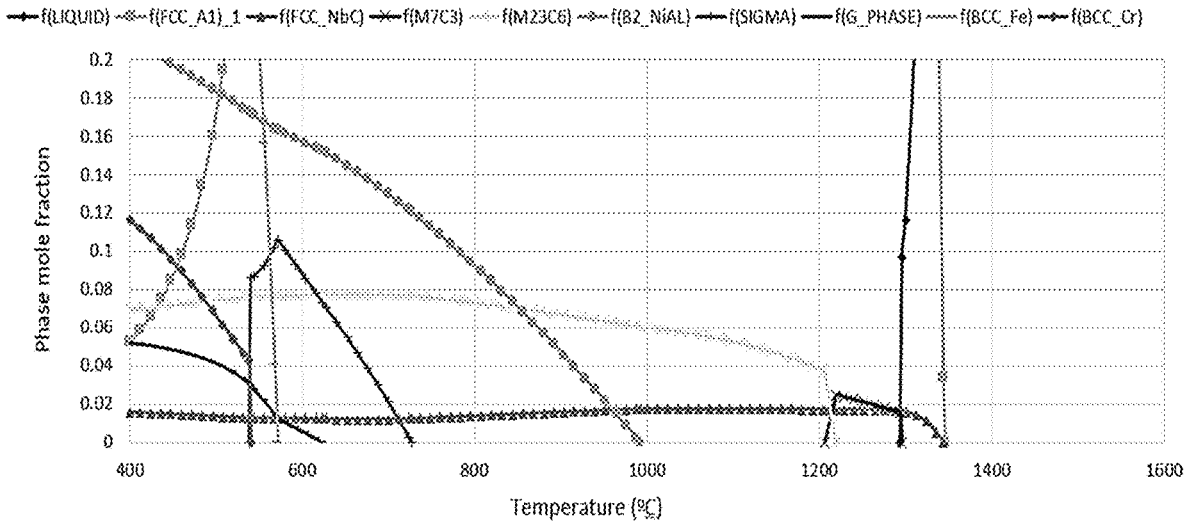
FIG. 27 shows a zoomed-inplot of phase mole fraction vs. temperature (° C.) for Alloy 2.2-1.
Figure 28:
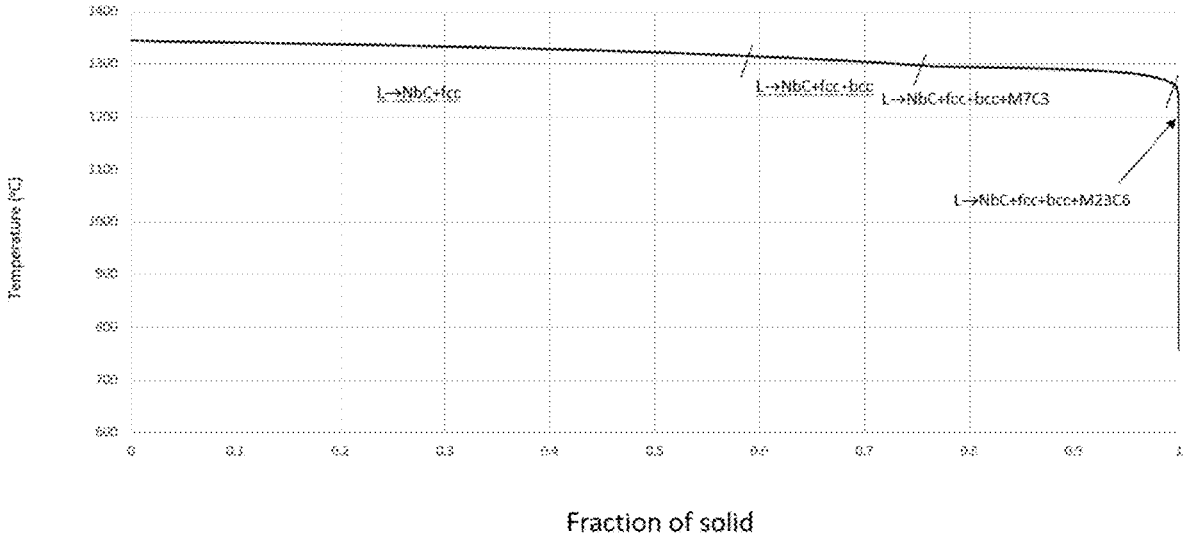
FIG. 28 shows a plot of temperature (° C.) vs. fraction of solid for Alloy 2.2-1.
Figure 29:
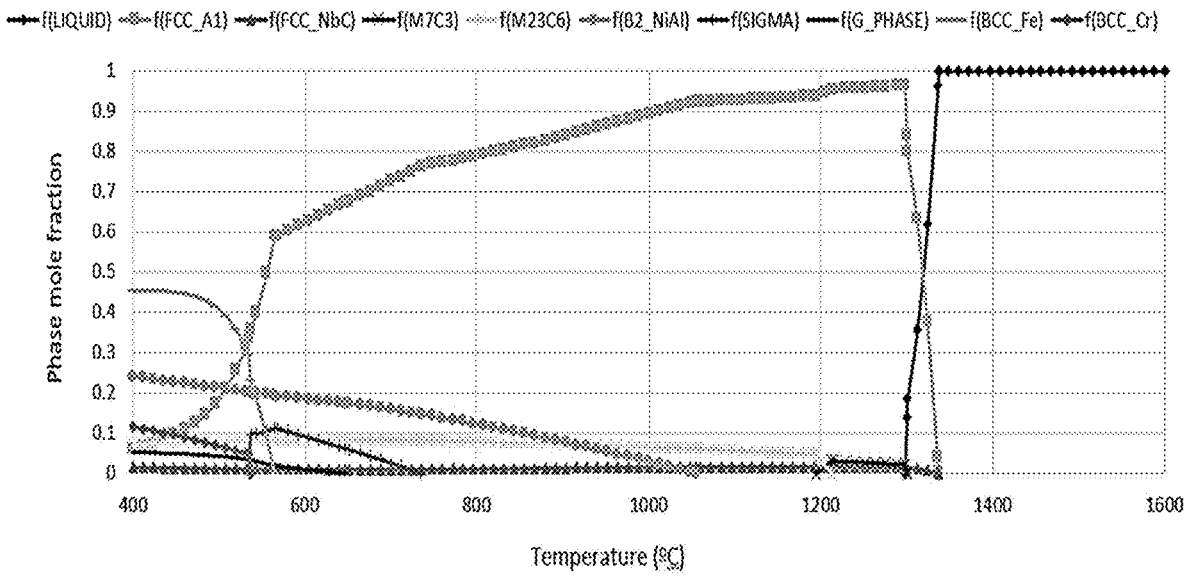
FIG. 29 shows a plot of phase mole fraction vs. temperature (° C.) for Alloy 2.3-1.
Figure 30:
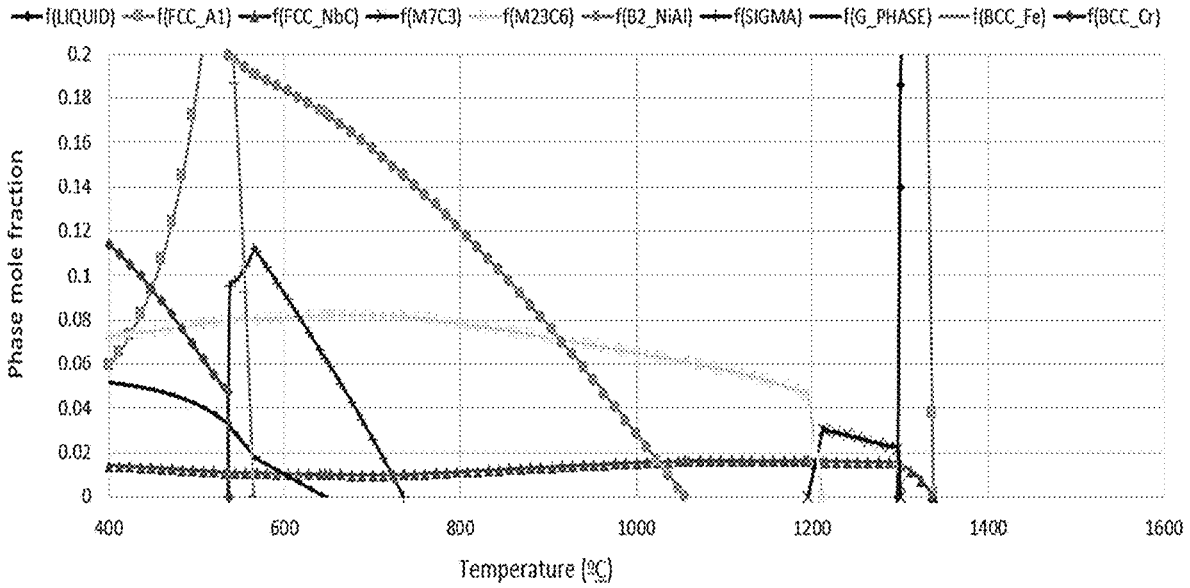
FIG. 30 shows a zoomed-in plot of phase mole fraction vs. temperature (° C.) for Alloy 2.3-1.
Figure 31:
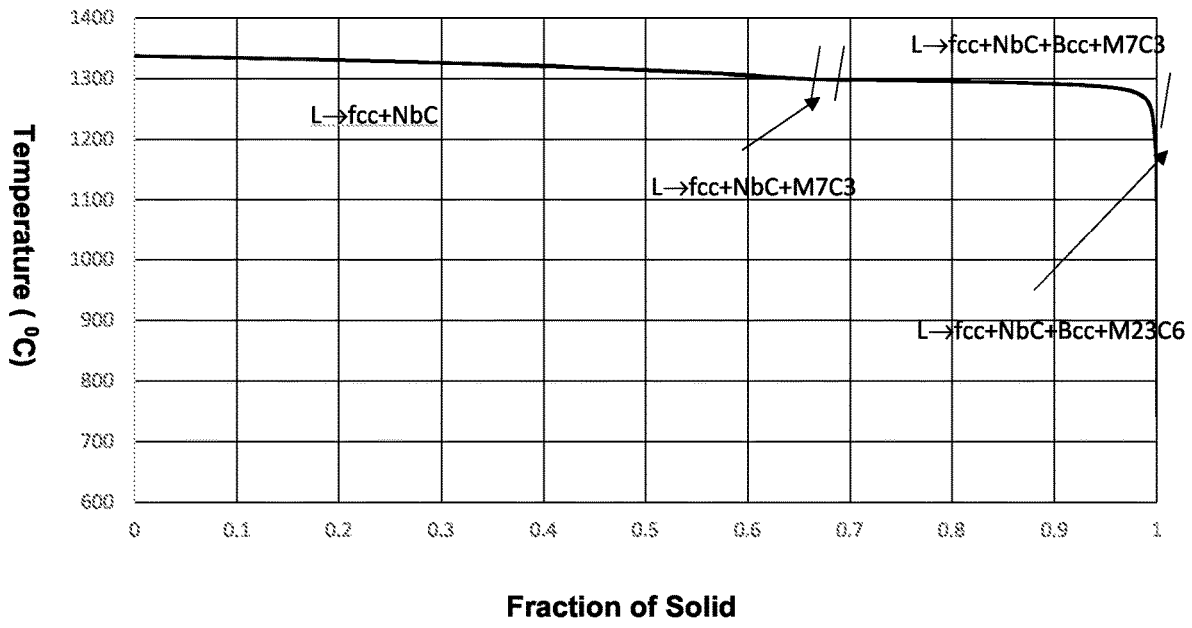
FIG. 31 shows a graph of of temperature (° C.) vs. fraction of solid for Alloy 2.3-1 during solidification
Figure 32:
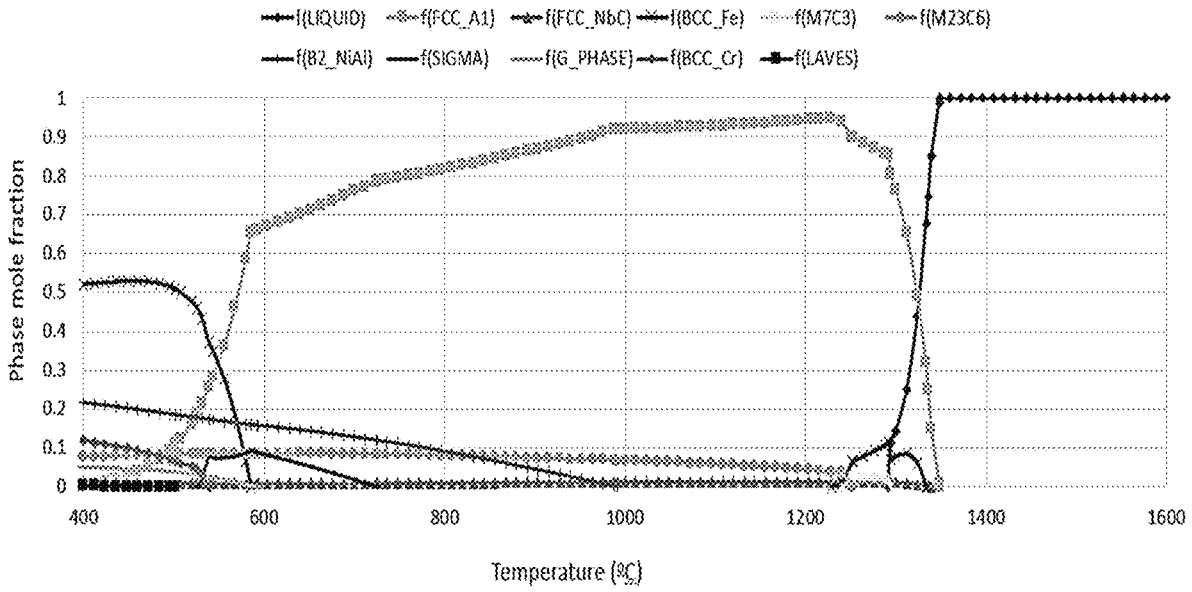
FIG. 32 shows a plot of phase mole fraction vs. temperature (° C.) for Alloy 2.4-1.
Figure 33:
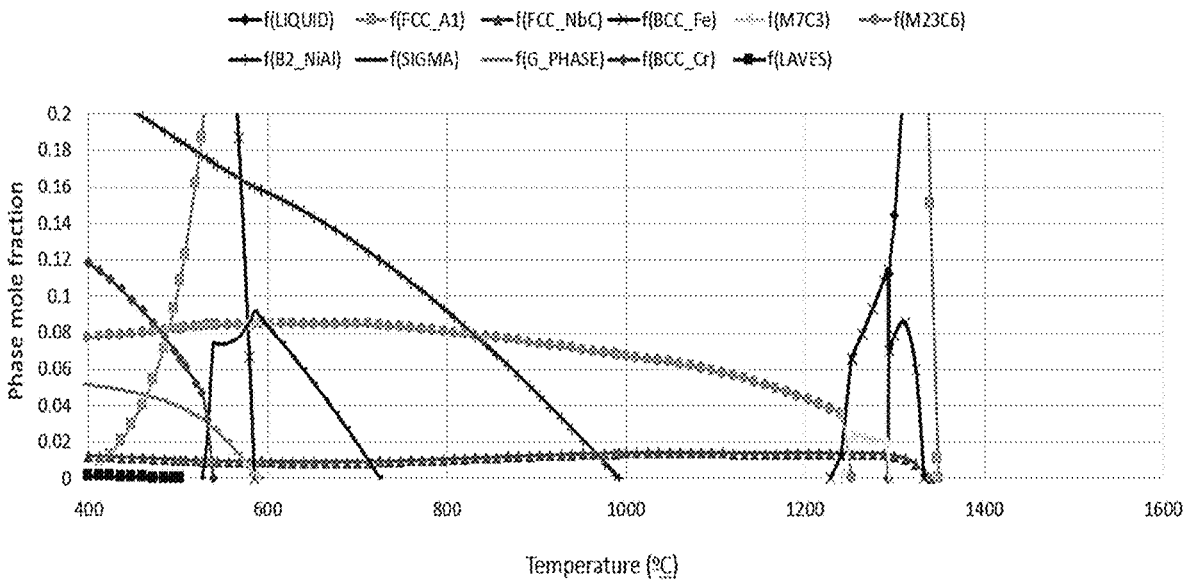
FIG. 33 shows a zoomed-in plot of phase mole fraction vs. temperature (° C.) for Alloy 2.4-1.
Figure 34:
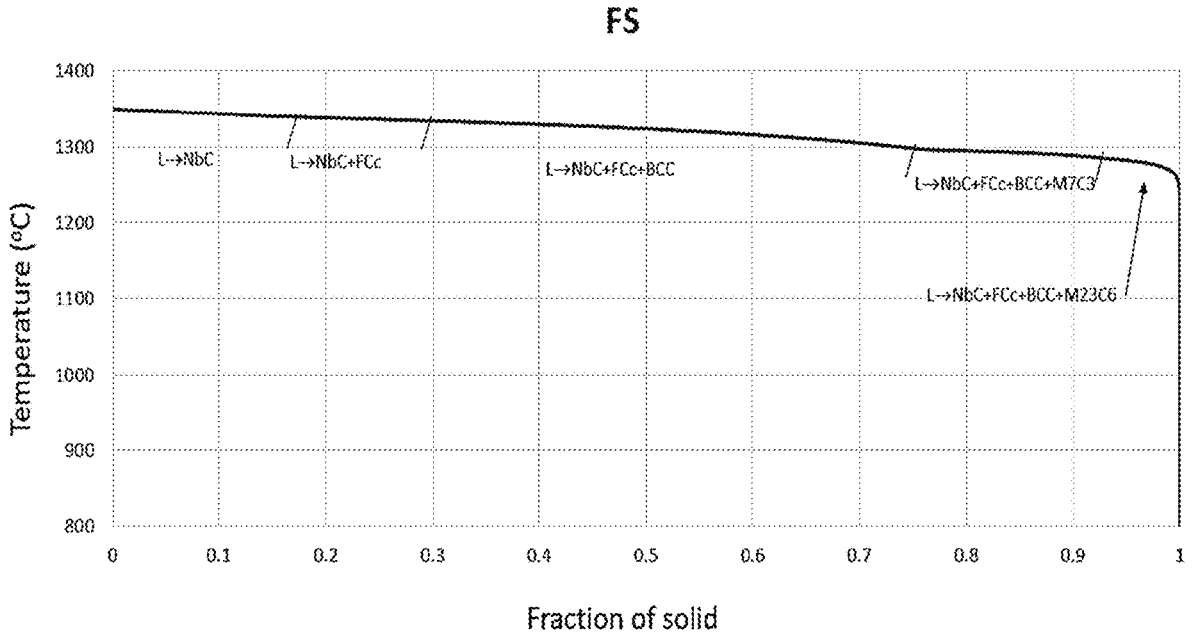
FIG. 34 shows a plot of temperature (° C.) vs. fraction of solid for Alloy 2.4-1 during solidification.
Figure 35:
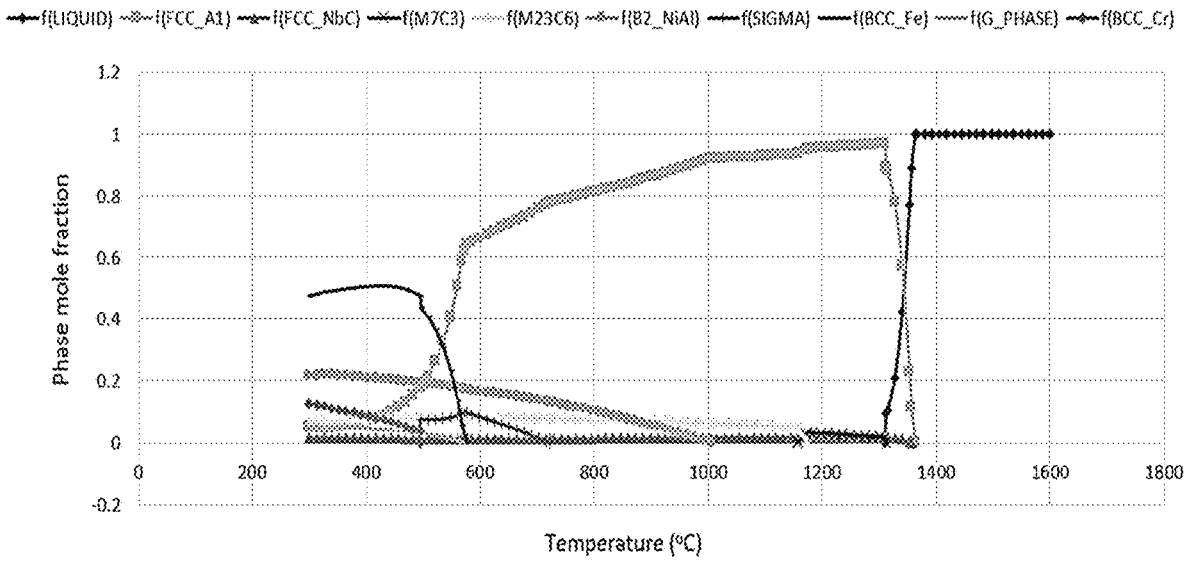
FIG. 35 shows a plot of phase mole fraction vs. temperature (° C.) for Alloy 2.5-1 full scale.
Figure 36:
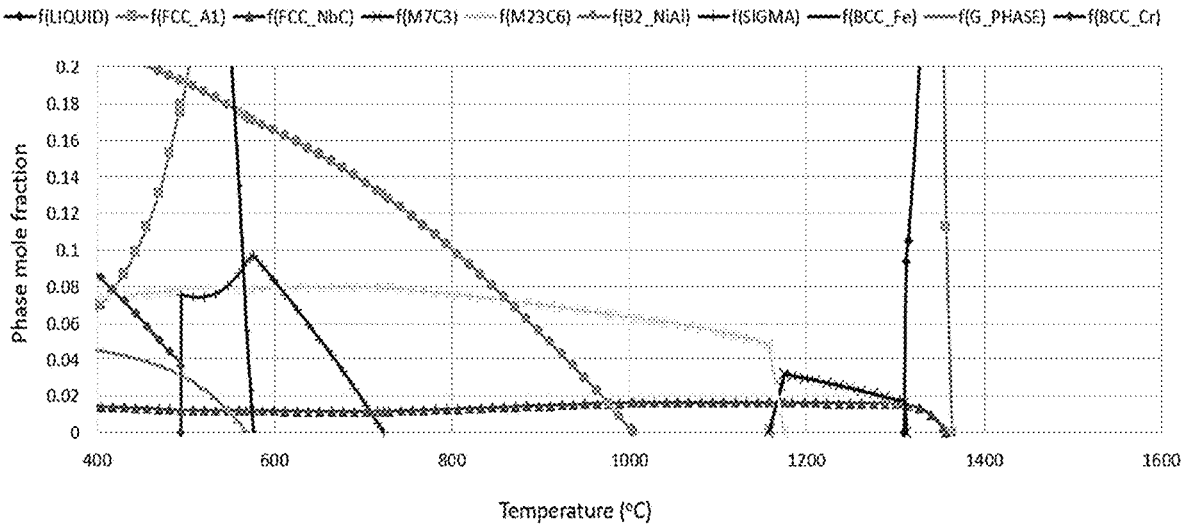
FIG. 36 shows a zoomed-in plot of phase mole fraction vs. temperature (° C.) for Alloy 2.5-1.
Figure 37:
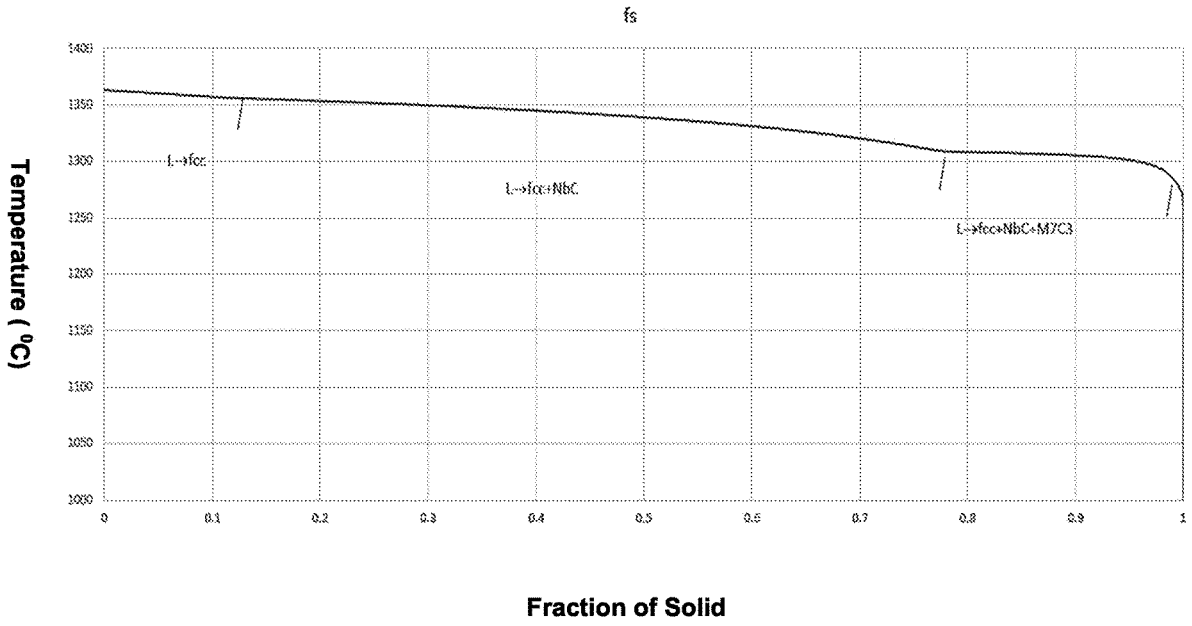
FIG. 37 shows a plot of temperature (° C.) vs. fraction of solid for Alloy 2.5-1 during solidification.

FIG. 18 illustrates the difference in the oxidation behavior of Al22, Al24, Al25 with that of Al2+ which shows that it is important to keep higher levels of Cu, W in the base alloy.

Comparing these same alloys also shows the importance of Ni. The Al2+ alloy (PJM-Al2) alloy has been melted as small heats of less than 0.5 lb., and a larger heat of 200 lb.

The results show that oxidation resistance of the Al-modified CF8C-Plus steels of the invention is much better reference alloys at 850-1000° C. in air +10% water vapor. The results also show that the creep strength of Al-modified CF8C-Plus steels of the invention is comparable to CF8C-Plus steel at 1000-1050° C. Creep rupture life at 1000° C. is the same, and rupture life at 1050° C. is a little less. The creep ductility of the Al-modified steels of the invention is good.

Example alloys without W and Cu show worse oxidation resistance, and illustrate the need for those elements. The absence of W and Cu can be compensated by the presence of Si.

The example alloys with reduced Ni levels (16-18%) also show worse oxidation resistance, emphasizing the need to have 20% Ni in the alloy for good behavior.

The example alloy with Al2+ and large castings show good tensile strength (35-40 Ksi) at room temperature to 700° C., and then still maintains 20 ksi at 800-900° C. Tensile ductility for Al2+ and CF8C-Plus is good from room temperature to 1000° C. The creep resistance is good at 850-950° C., better than the base CF8C-Plus alloy.

The prior art CF8C-Plus and the CN12-Plus alloys are austenitic stainless steels which can contain up to 3% Al. The alloys of the invention contain >3% Al and the ratio of Cr/Al can be 4.7-8 and the Cr/(Al+Si) ratio can be 2.25 to 6.15. The C and Nb levels of the alloys of the invention are above those levels specified in the CF8C-Plus alloy of U.S. Pat. No. 7,153,373, as are the C+N levels. The W and Cu levels in the invention alloys can be higher than the maximum allowable levels in the CF8C-Plus and the CN12-Plus alloy of U.S. Pat. No. 7,255,755, but they are not required for good oxidation and creep resistance in these alloys. The Ta addition to the invention alloys is new relative to both the CF8C-Plus and the CN12-Plus alloys.

The alloys of the invention can be air-cast. The Ni and Cr ranges of the wrought AFA alloy of U.S. Pat. No. 7,744,813 overlaps with the alloys of the invention, but the Al range is lower, and Cr/Al can be 4.7-8 and the Cr/(Al+Si) ratio can be 2.25 to 6.15. The Cu range of the alloys of the invention is higher than the wrought AFA alloy, but the invention alloys actually show superior strength without Cu, and the Nb range is higher as well.

The maximum Cu/W ratio specified for the alloys of the invention is much higher than the 0.17-0.5 range found in the wrought AFA alloy, but the minimum Cu/W ratio for the alloys of the invention is actually that for both Cu and W being 0.0% but Cu+W+Si=0.5-10.5%. The C range of the alloys of the invention is higher than that of the wrought AFA alloy, while the Nb/C ratio is lower for the alloys of the invention. The range of B in the wrought AFA alloy is much larger than the restricted B range of the alloys of the invention. The Cr and Al levels of the alloys of the invention are higher than the high Mn AFA alloys. The alloys of the invention have a higher Nb+Ta level than the high Mn AFA alloys and also have more Nb. Compared to the high Nb, Ta and Al AFA alloys of U.S. Pat. No. 7,754,305, the alloys of the invention have more Cr and higher Cr/Al ratios. The alloys of the invention have more C, and less B than the high Nb, Ta, and Al AFA alloys, and the alloys of the invention have specific Nb/Ta and Nb/C ratios, and have more N and less B.

With regard to the Fe-based superalloy AFA disclosed in US2013/0266477, the alloys of the invention have less Ni, and no Ti, and more C and more Mo+W. The Fe-based superalloys contain substantial gamma prime as a strengthening phase, whereas the alloys of the invention do not, and are strengthened by carbide (and nitride) precipitates instead. With regard to the cast AFA alloys of U.S. Pat. No. 8,431,072, the alloys of the invention contain more N (and more C+N), more Ta+Nb and specify a Nb/Ta ratio, and contain more Cu and W, yet have a lower Cu/W ratio, and have a higher Co range.

Cr in weight % can be found within the range of 18, 18.25, 18.50, 18.75, 19.0, 19.25, 19.50, 19.75, 20.0, 20.25, 20.50, 20.75, 21.0, 21.25, 21.50, 21.75, or 22% Cr. Cr can have a weight % within a range of any high value and low value selected from these values.

Ni in weight % can be found within the range of 15, 15.25, 15.50, 15.75, 16.0, 16.25, 16.50, 16.75, 17.0, 17.25, 17.50, 17.75, 18.0, 18.25, 18.50, 18.75, 19.0, 19.25, 19.50, 19.75, 20.0, 21.25, 21.50, 21.75, and 22% Ni. Ni can have a weight % within a range of any high value and low value selected from these values.

Al in weight % can be found within the range of 3, 3.25, 3.50, 3.75, 4.0, 4.25, 4.50, 4.75, 5.0, 5.25, 5.50, 5.75, or 6% Al. Al can have a weight % within a range of any high value and low value selected from these values.

Mn in weight % can be found within the range of 0.5, 0.75, 1.0, 1.25, 1.50, 1.75, 2.0, 2.25, 2.50, 2.75, 3.0, 3.25, 3.50, 3.75, 4.0, 4.25, 4.50, 4.75, or 5% Mn. Mn can have a weight % within a range of any high value and low value selected from these values.

W in weight % can be 0, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.0, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.0, 2.05, 2.10, 2.15, 2.20, 2.25, 2.30, 2.35, 2.40, 2.45, 2.50, 2.55, 2.60, 2.65, 2.70, 2.75, 2.80, 2.85, 2.90, 2.95, 3.0, 3.05, 3.10, 3.15, 3.20, 3.25, 3.30, 3.35, 3.40, 3.45, or 3.5% W. W can have a weight % within a range of any high value and low value selected from these values.

Cu in weight % can be found within the range of 0.0, 0.05, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1.0, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2.0, 2.05, 2.1, 2.15, 2.2, 2.25, 2.3, 2.35, 2.4, 2.45, 2.5, 2.55, 2.6, 2.65, 2.7, 2.75, 2.8, 2.85, 2.9, 2.95, 3.0, 3.05, 3.1, 3.15, 3.2, 3.25, 3.3, 3.35, 3.4, 3.45, 3.5, 3.55, 3.6, 3.65, 3.7, 3.75, 3.8, 3.85, 3.9, 3.95, 4.0, 3.05, 4.1, 4.15, 4.2, 4.25, 4.3, 4.35, 4.4, 4.45, 4.5, 4.55, 4.6, 4.65, 4.7, 4.75, 4.8, 4.85, 4.9, 4.95 or 5% Cu. Cu can have a weight % within a range of any high value and low value selected from these values.

Si in weight % can be found within the range of 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, or 2% Si. Si can have a weight % within a range of any high value and low value selected from these values.

Cu+W+Si can be 0.5, 0.75, 1.0, 1.25, 1.5, 1.75, 2.0, 2.25, 2.5, 2.75, 3.0, 3.25, 3.5, 3.75, 4.0, 4.25, 4.5, 4.75, 5.0, 5.25, 5.5, 5.75, 6.0, 6.25, 6.5, 6.75, 7.0, 7.25, 7.5, 7.75, 8.0, 7.25, 8.5, 8.75, 9.0, 9.25, 9.5, 9.75, 10.0, 10.25 or 10.5. The Cu+W+Si can be within a range of any high value and low value selected from these values.

Nb in weight % can be found within the range of 1.0, 1.25, 1.50, 1.75, 2.0, and 2.5% Nb. Nb can have a weight % within a range of any high value and low value selected from these values.

C in weight % can be found within the range of 0.3, 0.35, 0.4, 0.45, 0.5, 0.55, and 0.6% C. C can have a weight % within a range of any high value and low value selected from these values.

This invention can be embodied in many forms without departing from the spirit or essential attributes thereof, and accordingly reference should be made to the following claims to determine the scope of the invention.

TABLE 1

Typical ranges of alloy compositions

| Alloy | Fe | Cr | Ni | Mn | Cu | W | Si | Nb | Mo | Al | C | N |
|---|---|---|---|---|---|---|---|---|---|---|---|---|
| Alloy 2 | Bal | 20 | 20 | 4-5 | 3.0-4.0 | 3.0 | 1 | 1.75 | 0 | 3.5 | 0.5 | <0.1 |
| Alloy 3 | Bal | 20 | 20 | 4-5 | 4.0 | 3.0 | 1 | 1.75 | 0 | 3.5 | 0.5 | 0.1 |
| Alloy 5 | Bal | 20 | 20 | 4-5 | 4.0 | 3.0 | 1 | 1.75 | 0 | 4.0 | 0.5 | 0.2 |
| Alloy 2.2 | Bal | 20 | 18 | 4 | 0.0 | 0.0 | 1 | 1.5 | 0 | 3.5 | 0.5 | <0.1 |
| Alloy 2.3 | Bal | 20 | 20 | 4 | 0.0 | 0.0 | 1 | 1.5 | 0.0 | 4.0 | 0.5 | <0.1 |
| Alloy 2.4 | Bal | 20 | 16 | 4 | 0.0 | 0.5 | 1 | 1.3 | 0 | 3.5 | 0.5 | <0.1 |
| Alloy 2.5 | Bal | 20 | 20 | 1 | 0.0 | 0.0 | 1 | 1.5 | 0 | 3.5 | 0.5 | <0.1 |
| Alloy 2.22 | Bal | 20 | 18 | 4 | 4.0 | 3.0 | 1 | 1.7 | 0 | 3.5 | 0.5 | <0.1 |
| Alloy 2.33 | Bal | 20 | 20 | 4 | 4.0 | 3.0 | 1 | 1.7 | 0.0 | 4.0 | 0.5 | <0.1 |
| Alloy 2.44 | Bal | 20 | 16 | 4 | 4.0 | 3.0 | 1 | 1.5 | 0.0 | 3.5 | 0.6 | <0.1 |
| Alloy 2.55 | Bal | 20 | 20 | 1 | 4.0 | 3.0 | 1 | 1.5 | 0.0 | 3.5 | 0.5 | <0.1 |
| Alloy 2-1 | 43.6 | 20 | 20 | 4 | 3 | 3 | 0.7 | 1.7 | — | 3.5 | 0.5 | — |
| Alloy 2.1-1 | 49.6 | 20 | 20 | 4 | 0 | 0 | 0.7 | 1.7 | — | 3.5 | 0.5 | — |
| Alloy 2.2-1 | 51.7 | 20 | 18 | 4 | 0 | 0 | 0.7 | 1.6 | — | 3.5 | 0.5 | — |
| Alloy 2.3-1 | 49.3 | 20 | 20 | 4 | 0 | 0 | 0.7 | 1.5 | — | 4 | 0.5 | — |
| Alloy 2.4-1 | 53.5 | 20 | 16 | 4 | 0 | 0.5 | 0.7 | 1.3 | — | 3.5 | 0.5 | — |
| Alloy 2.5-1 | 52.8 | 20 | 20 | 1 | 0 | 0 | 0.7 | 1.5 | — | 3.5 | 0.5 | — |

25

TABLE 2

Reference Alloys

| Alloy | Fe | Cr | Ni | Mn | Cu | W | Si | Nb | Mo | Al | C | N |
|---|---|---|---|---|---|---|---|---|---|---|---|---|
| CN12-Plus | Bal | 25 | 16 | 4.5 | <0.3 | <0.01 | 0.7 | 1.5 | — | — | 0.4 | 0.4 |
| CN12-Plus CuW | Bal | 25 | 16 | 4.5 | 3.5 | 3.0 | 0.7 | 1.5 | — | — | 0.4 | 0.4 |
| CF8C-Plus | Bal | 19.5 | 12.5 | 4.0 | <0.3 | <0.01 | 0.7 | 0.9 | — | — | 0.09 | 0.25 |
| HK30Nb | Bal | 25 | 20.5 | 0.0 | 0.0 | 0.0 | 1.35 | 1.35 | — | — | 0.3 | 0.0 |
| DIN 1.4826 | Bal | 22 | 11 | 0.9 | 0.02 | 0.0 | 1.1 | 1.35 | — | — | 0.4 | 0.06 |
| D5S | Bal | 2 | 35 | 0.4 | — | — | 5 | — | 0.7 | 0 | 1.5 | — |
| F5N | Bal | 17.6 | 0.5 | 0.4 | 0.03 | 1.8 | 0.5 | 1.7 | — | — | 0.35 | 0.05 |
| 3C2N | Bal | 20 | 10.35 | 1 | 0.02 | 0.0 | 1 | 2 | — | — | 0.32 | 0.18 |
| Hitachi 20/10 | Bal | 20 | 10 | 1 | 0.0 | 3 | 0.15 | 2 | — | — | 045 | 0.0 |
| CAFA 6 | Bal | 14 | 25.5 | 2 | 0.5 | 1 | — | 0.9 | 2 | 3.5 | 0.45 | 0.0 |
| AFA 20[1] | Bal | 14.9 | 25.1 | 1.9 | 0.0 | 0.0 | 0.15 | 2.5 | 2.0 | 4.0 | 0.09 | NDA |
| CAFA 7 | Bal | 14.6 | 25.2 | 2.0 | 0.62 | 1.3 | 0.9 | 1.0 | 1.9 | 3.5 | 0.36 | NDA |

TABLE 3

Compositions of Tested Alloys

| Alloy | Fe | Cr | Ni | Mn | Co | Cu | W | Si | Nb | Mo | Al | C | N | S (ppm) |
|---|---|---|---|---|---|---|---|---|---|---|---|---|---|---|
| Al1 | 40.64 | 22.98 | 17.55 | 4.12 | 0.25 | 3.91 | 3.29 | 0.98 | 1.82 | 0.5 | 3.52 | 0.39 | 0.0007 | 26 |
| Al2* | Bal | 20 | 20 | 4.5 | — | 4.0 | 3.0 | 1 | 1.75 | — | 3.5 | 0.5 | <0.1 | |
| Al3* | Bal | 20 | 20 | 4.5 | 0 | 4.0 | 3.0 | 1 | 1.75 | 0 | 3.5 | 0.5 | 0.1 | — |
| Al5* | Bal | 20 | 20 | 4.5 | 0 | 4.0 | 3.0 | 1 | 1.75 | 0 | 4.0 | 0.5 | 0.2 | — |
| Al2+ | 48.9 | 20.92 | 20.23 | 3.61 | 0.02 | 0.024 | 0.002 | 1.03 | 1.64 | 0.04 | 2.91 | 0.51 | 0.059 | 75 |
| Large Al2 Casting 1* | Bal | 20 | 20 | 4 | 0 | 4 | 3.0 | 1 | 1.75 | 0 | 3.5 | 0.5 | <0.1 | — |

TABLE 3-continued

Compositions of Tested Alloys

| Alloy | Fe | Cr | Ni | Mn | Co | Cu | W | Si | Nb | Mo | Al | C | N | S (ppm) |
|---|---|---|---|---|---|---|---|---|---|---|---|---|---|---|
| Large Al2 Casting 2* | Bal | 20 | 20 | 4 | 0 | 4 | 3.0 | 1 | 1.75 | 0 | 3.5 | 0.5 | <0.1 | — |
| Al24 | 52.99 | 20.35 | 16.24 | 3.89 | 0 | 0 | 0.46 | 0.70 | 1.32 | 0 | 3.55 | 0.49 | 0.0006 | 20 |
| Al25 | 52.43 | 20.38 | 20.13 | 0.9 | 0 | 0 | 0 | 0.55 | 1.51 | 0 | 3.57 | 0.50 | 0.0004 | 20 |
| Al222* | Bal | 20 | 18 | 4 | 0 | 4.0 | 3.0 | 1 | 1.7 | 0 | 3.5 | 0.5 | <0.1 | — |
| Al233 | 41.81 | 20.34 | 20.09 | 3.89 | 0.31 | 3.99 | 2.99 | 0.28 | 1.71 | 0 | 4.05 | 0.5 | 0.0006 | 20 |
| Al244* | Bal | 20 | 16 | 4 | 0 | 4.0 | 3.0 | 1 | 1.5 | 0.0 | 3.5 | 0.6 | <0.1 | — |
| Al255* | Bal | 20 | 20 | 1 | 0 | 4.0 | 3.0 | 1 | 1.5 | 0.0 | 3.5 | 0.5 | <0.1 | — |

*indicates that alloy composition reported is the target composition

TABLE 4

Mole fraction of phases at 850, 900 and 950° C. for example alloys

| Alloy Designation | Temperature | FCC_A1 | FCC_NbC | M23C6 | B2_NiAl | LAVES | SIGMA |
|---|---|---|---|---|---|---|---|
| Alloy 2-1 | 850 | 0.799889 | 0.014968 | 0.073755 | 0.072546 | 0.004191 | 0.03266 |
| | 900 | 0.863112 | 0.016186 | 0.070686 | 0.044782 | 0.005235 | |
| | 950 | 0.892152 | 0.017446 | 0.067416 | 0.021687 | 0.001299 | |
| Alloy 2.1-1 | 850 | 0.847691 | 0.015716 | 0.068363 | 0.06823 | | |
| | 900 | 0.872579 | 0.016698 | 0.065318 | 0.045406 | | |
| | 950 | 0.899113 | 0.017607 | 0.06212 | 0.021161 | | |
| Alloy 2.2-1 | 850 | 0.847057 | 0.014754 | 0.0701 | 0.068089 | | |
| | 900 | 0.872056 | 0.01571 | 0.066971 | 0.045263 | | |
| | 950 | 0.898729 | 0.016586 | 0.063654 | 0.021031 | | |
| Alloy 2.3-1 | 850 | 0.815089 | 0.012421 | 0.075224 | 0.097267 | | |
| | 900 | 0.839049 | 0.013438 | 0.072072 | 0.075441 | | |
| | 950 | 0.864479 | 0.014404 | 0.068716 | 0.052401 | | |
| Alloy 2.4-1 | 850 | 0.843882 | 0.011642 | 0.077091 | 0.067384 | | |
| | 900 | 0.868752 | 0.012576 | 0.073895 | 0.044777 | | |
| | 950 | 0.895292 | 0.013422 | 0.07049 | 0.020796 | | |
| Alloy 2.5-1 | 850 | 0.832815 | 0.013506 | 0.073247 | 0.080433 | | |
| | 900 | 0.859646 | 0.014469 | 0.070092 | 0.055793 | | |
| | 950 | 0.888546 | 0.015369 | 0.066664 | 0.029422 | | |

TABLE 5

Creep Properties of Exemplary Alloy

| Temperature (° C.) | Stress (MPa) | Rupture Life |
|---|---|---|
| 800 | 75 | 417.2 |
| 850 | 50 | 2451.5 |
| 900 | 50 | 545.3 |
| 950 | 35 | 863.4 |
| 1000 | 25 | 576.2 |
| 1050 | 10 | 469 |

TABLE 6

Tensile Properties of Exemplary Alloy

| Temperatures | Yield Strength (Ksi) | Tensile Strength (Ksi) | Elongation (%) |
|---|---|---|---|
| 25° C. | 41.6 | 84.1 | 11.2 |
| 200° C. | 33.9 | 67 | 9.4 |
| 400° C. | 34.3 | 68.2 | 12.8 |
| 600° C. | 35.2 | 65.3 | 12.8 |
| 700° C. | 33.5 | 56.8 | 16 |

TABLE 6-continued

Tensile Properties of Exemplary Alloy

| Temperatures | Yield Strength (Ksi) | Tensile Strength (Ksi) | Elongation (%) |
|---|---|---|---|
| 800° C. | 22.7 | 37.5 | 22 |
| 900° C. | 17.9 | 21.0 | 28.8 |
| 1000° C. | 10.5 | 12.2 | 39 |

The alloys of the invention provide a good combination of oxidation resistance and creep resistance at low cost by balancing Ni, Cr, Al, Cu, W and Si levels. The effect of Si in improving oxidation resistance in the absence of Cu and W is unexpected.

What is claimed is:

1. An air castable Fe-based stainless steel alloy comprising in weight % based on the total weight of the alloy:

18-22% Cr
15-22% Ni
3.25-6% Al
0.5-5% Mn
1.05-3.5% W 3.05-5% Cu
0-2% Si
1-2.5% Nb
0.3-0.6% C
<0.1% N
balance Fe
wherein, Cu+W+Si=4.1-10.5%, and the alloy provides an oxidation resistance of −2<mass change <+2 mg/cm$^2$ after 300 one hour cycles at 950° C. in 10% water vapor.

2. The alloy of claim 1, further comprising 0-2% Ta.

3. The alloy of claim 2, wherein Ta+Nb<4.0%.

4. The alloy of claim 2, wherein Ta/Nb=0-0.75.

5. The alloy of claim 1, further comprising 0.1-5.0% Co.

6. The alloy of claim 1, wherein the alloy is non-magnetic and free of alpha or delta ferrite phases, and does not form a thermal or strain induced martensite phase.

7. The alloy of claim 1, wherein the Cu/W ratio is 0.87-1.67.

8. The alloy of claim 1, wherein Nb/C is from 2-5.

9. The alloy of claim 1, wherein Cr/Al is 4.7-6.77.

10. The alloy of claim 1, wherein the Cr/(Al+Si) ratio is 2.25-6.15.

11. The alloy of claim 1, wherein the alloy provides an oxidation resistance of −0.5<mass change <+2 mg/cm$^2$ after 400 one hour cycles at 900° C. in 10% water vapor.

12. The alloy of claim 1, wherein the alloy provides creep rupture resistance of 863 hours at 950° C., 35 MPa and 469 hours at 1050° C., 10 MPa.

13. The alloy of claim 1, wherein the alloy provides a yield strength of 41.6 Ksi and tensile strength of 84.1 Ksi at room temperature.

14. The alloy of claim 1, wherein the alloy provides an elongation of 11.1% at room temperature and 39% at 1000° C.

* * * * *